US011565899B2

(12) United States Patent
Niwa

(10) Patent No.: US 11,565,899 B2
(45) Date of Patent: Jan. 31, 2023

(54) RECORDING-MATERIAL-TRANSPORTING DEVICE AND IMAGE FORMING APPARATUS

(71) Applicant: FUJIFILM Business Innovation Corp., Tokyo (JP)

(72) Inventor: Masahito Niwa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 271 days.

(21) Appl. No.: 16/846,418

(22) Filed: Apr. 13, 2020

(65) Prior Publication Data

US 2021/0171300 A1 Jun. 10, 2021

(30) Foreign Application Priority Data

Dec. 5, 2019 (JP) ..... JP2019-220720

(51) Int. Cl.
*B65H 3/08* (2006.01)
*G03G 15/00* (2006.01)

(52) U.S. Cl.
CPC ..... *B65H 3/08* (2013.01); *G03G 15/6529* (2013.01); *B65H 2406/31* (2013.01)

(58) Field of Classification Search
CPC . B65H 3/08; B65H 3/12; B65H 3/124; B65H 3/128; B65H 2406/30; B65H 2406/31; B65H 2406/35; B65H 2406/352
See application file for complete search history.

(56) References Cited

U.S. PATENT DOCUMENTS 6,398,206 B1 * 6/2002 Yang ..... B65H 3/0883 271/107
6,398,207 B1 6/2002 Taylor et al.
8,608,157 B2 * 12/2013 Fujikura ..... B65H 7/02 271/106
2013/0020755 A1 * 1/2013 Kitazawa ..... B65H 3/0883 271/108
2015/0220054 A1 * 8/2015 Otsuka ..... B65H 3/0816 271/18.1

FOREIGN PATENT DOCUMENTS

JP 2002019978 1/2002

* cited by examiner

*Primary Examiner* — Prasad V Gokhale
(74) *Attorney, Agent, or Firm* — JCIPRNET

(57) ABSTRACT

A recording-material-transporting device includes a suction unit that suctions a recording material included in a recording-material stack from above, the suction unit including a movable member that moves upward when pushed from below by the recording material moving upward with the suction, the suction unit being movable in an intersecting direction intersecting a vertical direction and moving the suctioned recording material in the intersecting direction, at least a part of the movable member serving as an outside advancing part that advances to an outside of a perimeter of the recording-material stack with the movement of the suction unit in the intersecting direction; and a restricting part that restricts a downward movement of the outside advancing part when the outside advancing part is free of support by the recording material from below.

16 Claims, 19 Drawing Sheets

RECORDING-MATERIAL-TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2019-220720 filed Dec. 5, 2019.

BACKGROUND

(i) Technical Field

The present disclosure relates to a recording-material-transporting device and an image forming apparatus.

(ii) Related Art

A sheet feeding device disclosed by Japanese Unexamined Patent Application Publication No. 2002-19978 includes an air sending device that generates a vacuum pressure in an air plenum so that a sheet included in a sheet stack is suctioned and is brought into contact with the air plenum and with a sealing mechanism.

SUMMARY

Some of devices having a function of transporting recording materials include a suction unit having a movable member that is movable up and down. The suction unit suctions a recording material from above a stack of recording materials. After the suction unit picks up a recording material by suctioning the recording material, the suction unit may move in a direction intersecting the vertical direction.

If the suction fails or if the recording material is displaced with respect to the suction unit, the recording material, whether suctioned to the suction unit or not, may not be present directly below the movable member when the suction unit moves.

If the suction unit moves with no recording material being present directly below the movable member, the movable member may be lowered when the movable member advances to the outside of the perimeter of the stack of recording materials. Furthermore, when the suction unit returns to the initial position, the movable member may interfere with some recording materials included in the stack of recording materials. If the movable member interferes with any recording materials, the recording materials and/or the movable member may be damaged.

Aspects of non-limiting embodiments of the present disclosure relate to reducing the probability of fault occurrence due to interference between a movable member that is movable up and down and recording materials, lower than in a configuration including no mechanism of restricting a downward movement of the movable member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording-material-transporting device including a suction unit that suctions a recording material included in a recording-material stack from above, the suction unit including a movable member that moves upward when pushed from below by the recording material moving upward with the suction, the suction unit being movable in an intersecting direction intersecting a vertical direction and moving the suctioned recording material in the intersecting direction, at least a part of the movable member serving as an outside advancing part that advances to an outside of a perimeter of the recording-material stack with the movement of the suction unit in the intersecting direction; and a restricting part that restricts a downward movement of the outside advancing part when the outside advancing part is free of support by the recording material from below.

BRIEF DESCRIPTION OF THE DRAWINGS

An exemplary embodiment of the present disclosure will be described in detail based on the following figures, wherein.

DETAILED DESCRIPTION

Figure 1:
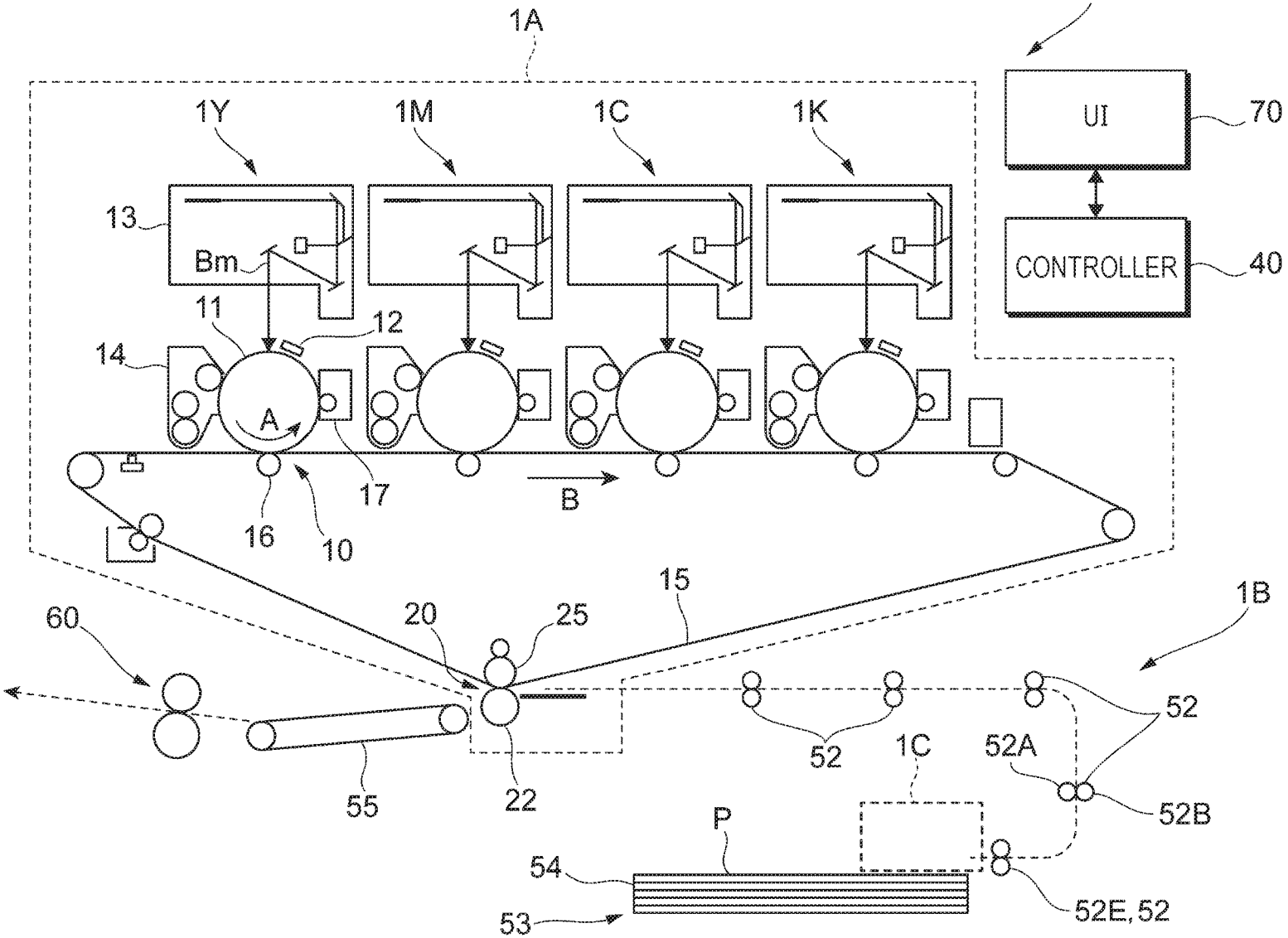
FIG. 1 is a schematic diagram of an image forming apparatus.

FIG. 1 is a schematic diagram of an image forming apparatus 1 according to an exemplary embodiment of the present disclosure.

The image forming apparatus 1 illustrated in FIG. 1 is of a so-called tandem type and employs an intermediate transfer method. The image forming apparatus 1 includes an image forming section 1A that forms an image on a sheet P, which is an exemplary recording material. The image forming apparatus 1 further includes a sheet transporting device 1B that feeds and transports sheets P one by one from a stack of sheets P placed on a sheet stacking unit 53.

The image forming section 1A, which is an exemplary image forming device, includes a plurality of image forming units 1Y, 1M, 1C, and 1K that electrophotographically form toner images by using different color components, respectively.

The image forming section 1A further includes first transfer parts 10 where the toner images formed by the image forming units 1Y, 1M, 1C, and 1K with the respective color components are sequentially transferred (first-transferred) to an intermediate transfer belt 15 such that the toner images are superposed one on top of another. The image forming section 1A further includes a second transfer part 20 where the toner images superposed on the intermediate transfer belt 15 are collectively transferred (second-transferred) to a sheet P.

The image forming apparatus 1 further includes a fixing device 60 that fixes the toner images second-transferred to the sheet P.

The image forming apparatus 1 further includes a controller 40 that controls operations of relevant devices (units), and a use interface (UI) 70 including a display panel and so forth and that receives information from a user and displays information to the user.

The image forming units 1Y, 1M, 1C, and 1K each include the following.

A photoconductor drum 11 that rotates in a direction of arrow A is provided therearound with a charging device 12 that charges the photoconductor drum 11, an exposure device 13 that forms an electrostatic latent image on the photoconductor drum 11, and a developing device 14 that develops the electrostatic latent image on the photoconductor drum 11 with toner.

The image forming units 1Y, 1M, 1C, and 1K each further include a first transfer roller 16, with which the toner image formed on the photoconductor drum 11 with a corresponding one of the color components is transferred to the intermediate transfer belt 15 at the first transfer part 10.

The image forming units 1Y, 1M, 1C, and 1K each further include a drum cleaner 17 that removes residual toner and the like from the photoconductor drum 11.

The intermediate transfer belt 15 rotates at a predetermined speed in a direction of arrow B illustrated in FIG. 1.

The first transfer part 10 is defined by the first transfer roller 16 provided across the intermediate transfer belt 15 from the photoconductor drum 11.

In the present exemplary embodiment, the toner images on the respective photoconductor drums 11 are sequentially electrostatically attracted to the intermediate transfer belt 15, whereby a superposition of toner images is formed on the intermediate transfer belt 15.

The second transfer part 20 is defined by a second transfer roller 22 facing the outer peripheral surface of the intermediate transfer belt 15, and a backup roller 25.

The second transfer roller 22 is pressed against the backup roller 25 with the intermediate transfer belt 15 interposed therebetween. A voltage is applied between the second transfer roller 22 and the backup roller 25, whereby the toner images are second-transferred to a sheet P transported to the second transfer part 20.

In the present exemplary embodiment, image data is outputted from an image reading device, a personal computer (PC), or the like (not illustrated) to the image forming apparatus 1.

The image data is processed by an image processing device (not illustrated) into pieces of image data generated for the four respective colors of Y, M, C, and K. The pieces of image data are outputted to the respective exposure devices 13 provided for the four respective colors of Y, M, C, and K.

The exposure devices 13 each emit exposure beam Bm from, for example, a semiconductor laser to the photoconductor drum 11 of a corresponding one of the image forming units 1Y, 1M, 1C, and 1K in accordance with a corresponding one of the pieces of image data received.

After the surfaces of the photoconductor drums 11 are charged by the charging devices 12, the surfaces are subjected to scan exposure performed by the exposure devices 13. Thus, electrostatic latent images are formed on the respective photoconductor drums 11.

Subsequently, toner images are formed on the respective photoconductor drums 11 by the respective developing devices 14 and are transferred to the intermediate transfer belt 15 at the respective first transfer parts 10, where the photoconductor drums 11 are in contact with the intermediate transfer belt 15.

The toner images sequentially first-transferred to the surface of the intermediate transfer belt 15 are transported to the second transfer part 20 with the rotation of the intermediate transfer belt 15.

At the second transfer part 20, the second transfer roller 22 is pressed against the backup roller 25 with the intermediate transfer belt 15 interposed therebetween. A sheet P is transported from the sheet stacking unit 53 and is nipped between the intermediate transfer belt 15 and the second transfer roller 22.

Thus, the toner images, which are yet to be fixed, on the intermediate transfer belt 15 are collectively electrostatically transferred to the sheet P at the second transfer part 20.

The sheet P having the toner images transferred thereto then passes through the fixing device 60 and is outputted to a sheet output part (not illustrated).

The transport of the sheet P from the sheet stacking unit 53 through the second transfer part 20 and the fixing device 60 to the sheet output part is performed by the sheet transporting device 1B, which is an exemplary recording-material-transporting device.

The sheet transporting device 1B includes a sheet feeding section 1C that feeds the topmost one of the sheets P stacked on the sheet stacking unit 53.

The sheet transporting device 1B further includes a plurality of transport rollers 52 that transport the sheet P fed from the sheet feeding section 1C.

The transport rollers 52 each include a driving roller 52A that rotates by receiving a driving force from a motor (not illustrated), and a follower roller 52B that is in contact with the driving roller 52A and rotates by receiving the driving force from the driving roller 52A.

In the present exemplary embodiment, the sheet P fed from the sheet feeding section 1C is first transported by one of the plurality of transport rollers 52 that is positioned on the upstreammost side in the direction of transport of the sheet P (the transport roller 52 on the upstreammost side is hereinafter referred to as "upstreammost transport roller 52E").

The sheet P is further transported by the other transport rollers 52 that are positioned on the downstream side with respect to the upstreammost transport roller 52E to the second transfer part 20 and then to the fixing device 60.

The sheet transporting device 1B further includes a transport belt 55.

The transport belt 55 is provided on the downstream side with respect to the second transfer roller 22 in the direction of transport of the sheet P (hereinafter referred to as "sheet transporting direction"). The transport belt 55 transports the sheet P having undergone second transfer to the fixing device 60.

FIGS. 2A to 2D illustrate the sheet feeding section 1C. FIG. 3 is a perspective view of a suction unit 100 (to be described below) seen in a direction of arrow III illustrated in FIG. 2A.

Figure 2A:
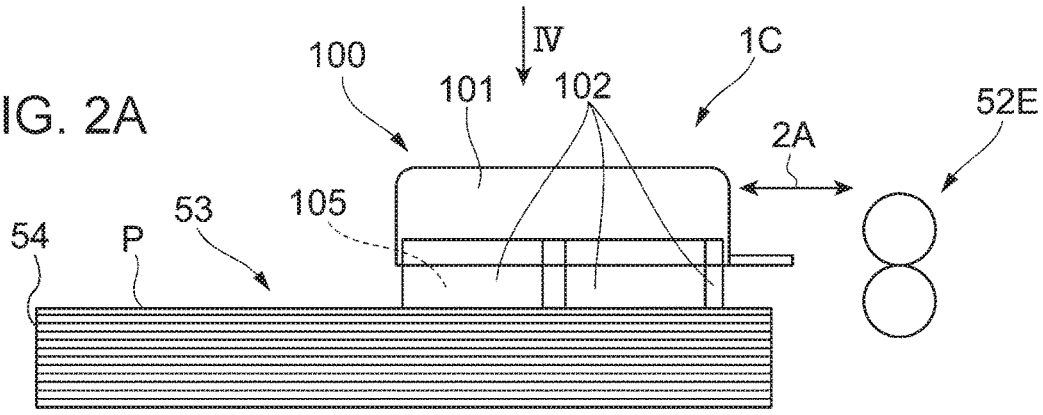
FIGS. 2A to 2D illustrate a sheet feeding section.
Figure 3:
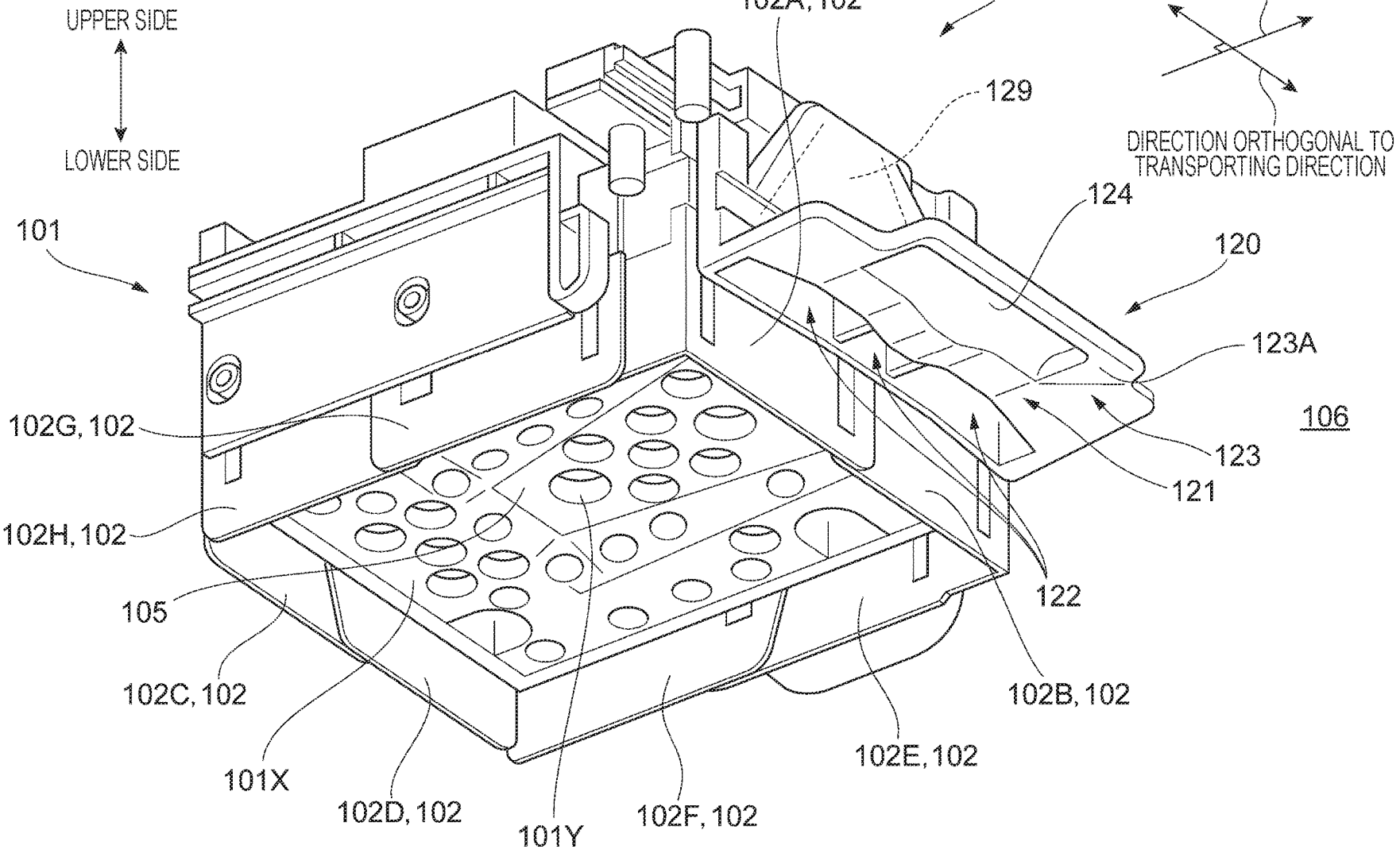
FIG. 3 is a perspective view of a suction unit seen in a direction of arrow III illustrated in FIG. 2A.

As illustrated in FIG. 2A, the sheet feeding section 1C includes the suction unit 100. The suction unit 100 suctions one of the sheets P stacked on the sheet stacking unit 53. The sheet feeding section 1C further includes a moving mechanism (not illustrated) that moves the suction unit 100 in directions represented by arrow 2A illustrated in FIG. 2A.

The moving mechanism may be a publicly known mechanism including any of a motor, a gear, a rack, a pinion, a belt drive mechanism, and so forth and is not limited to a specific mechanism.

In the present exemplary embodiment, as represented by arrow 2A, the suction unit 100 is moved by the moving mechanism in a direction toward the upstreammost transport roller 52E and in a direction away from the upstreammost transport roller 52E.

Specifically, in the present exemplary embodiment, the suction unit 100 is moved by the moving mechanism in the direction toward the upstreammost transport roller 52E from a position above a sheet stack 54, which is an exemplary recording-material stack. Furthermore, in the present exemplary embodiment, the suction unit 100 having been moved toward the upstreammost transport roller 52E is moved by the moving mechanism toward the sheet stack 54 to return to the position above the sheet stack 54.

As illustrated in FIG. 2A, the suction unit 100 includes a rectangular parallelepiped unit body 101, and a plurality of movable members 102 each hanging down from the unit body 101.

The unit body 101 is provided with a suction tube (not illustrated). In the present exemplary embodiment, as to be described below, the unit body 101 suctions a sheet P.

The movable members 102 each have a plate shape and are movable up and down.

In the present exemplary embodiment, as illustrated in FIG. 3, the movable members 102 are a first leading-end movable member 102A, a second leading-end movable member 102B, a first trailing-end movable member 102C, a second trailing-end movable member 102D, a first right movable member 102E, a second right movable member 102F, a first left movable member 102G, and a second left movable member 102H.

In the present exemplary embodiment, the above eight movable members 102 separate a rectangular parallelepiped depressurized space 105 positioned below the unit body 101 from an atmospheric space 106 positioned around the depressurized space 105.

In the present exemplary embodiment, a rectangular parallelepiped space enclosed by the eight movable members 102 corresponds to the depressurized space 105. Furthermore, a space outside the depressurized space 105 corresponds to the atmospheric space 106 that is at atmospheric pressure.

More specifically, in the present exemplary embodiment, a lower surface 101X of the unit body 101 has a plurality of holes 101Y, and air in the depressurized space 105 is suctioned through the hoes 101Y. Thus, the pressure in the depressurized space 105 is reduced to be lower than the atmospheric pressure.

In the present exemplary embodiment, when air in the depressurized space 105 is suctioned and the pressure in the depressurized space 105 is thus reduced, referring to FIGS. 2A and 2B, a sheet P positioned below the depressurized space 105 is suctioned and moves toward the lower surface 101X (see FIG. 2B) of the unit body 101.

Thus, the sheet P is attracted to the lower surface 101X, which is an exemplary attracting part. In other words, in the present exemplary embodiment, a sheet P is attracted to the lower surface 101X. More specifically, in the present exemplary embodiment, a sheet P is attracted to the lower surface 101X from below. To summarize, in the present exemplary embodiment, the suction unit 100 suctions a sheet P from above the sheet stack 54, and the sheet P is attracted to the suction unit 100 from below.

The lower surface 101X is an exemplary attracting part and is flat. In the present exemplary embodiment, the attracting part has a planar shape, and a sheet P is attracted to the planar attracting part. In other words, in the present exemplary embodiment, a sheet P is attracted to an attracting surface.

Figure 2B:
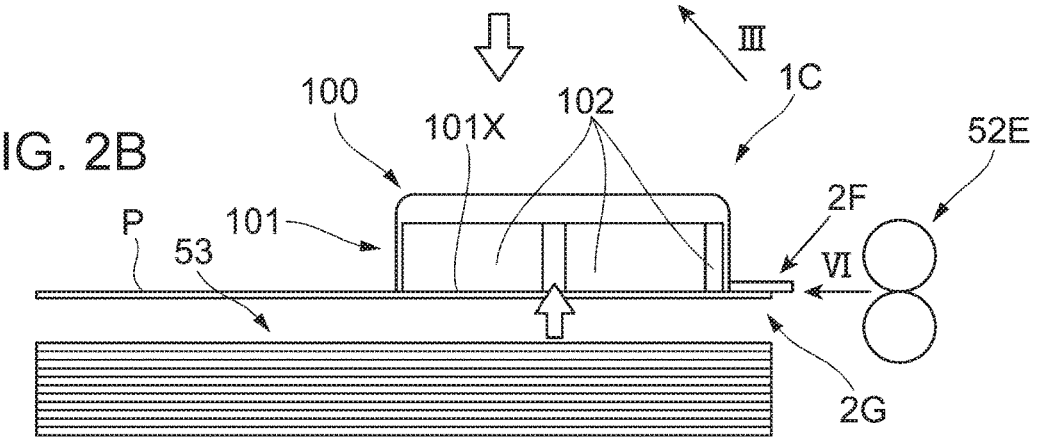

In the present exemplary embodiment, when a sheet P is attracted to the lower surface 101X of the unit body 101, the eight movable members 102 illustrated in FIG. 3 and positioned as illustrated in FIG. 2A move upward to be positioned as illustrated in FIG. 2B.

More specifically, in the present exemplary embodiment, a sheet P is attracted to the lower surface 101X illustrated in FIG. 3 as follows. The eight movable members 102 are pushed from below by the sheets P positioned therebelow and are thus moved upward. When the eight movable members 102 have been moved upward, a sheet P is attracted to the lower surface 101X of the unit body 101.

In the present exemplary embodiment, while a sheet P is being attracted to the lower surface 101X, air is blown to an edge 2G of the sheet P attracted to the lower surface 101X. The air is blown from the upper side with respect to the lower surface 101X as represented by arrow 2F in FIG. 2B.

In other words, in the present exemplary embodiment, air is blown to the edge 2G from the upper side with respect to the edge 2G of the sheet P attracted to the lower surface 101X.

More specifically, in the present exemplary embodiment, the edge 2G illustrated in FIG. 2B is positioned at the leading end of the sheet P when the sheet P is transported (the edge 2G is hereinafter referred to as "leading-end edge 2G"), and air is blown to the leading-end edge 2G from the upper side.

While the present exemplary embodiment concerns a case where air is blown to the leading-end edge 2G, air may be blown from the upper side to any edge other than the leading-end edge 2G.

Figure 2C:
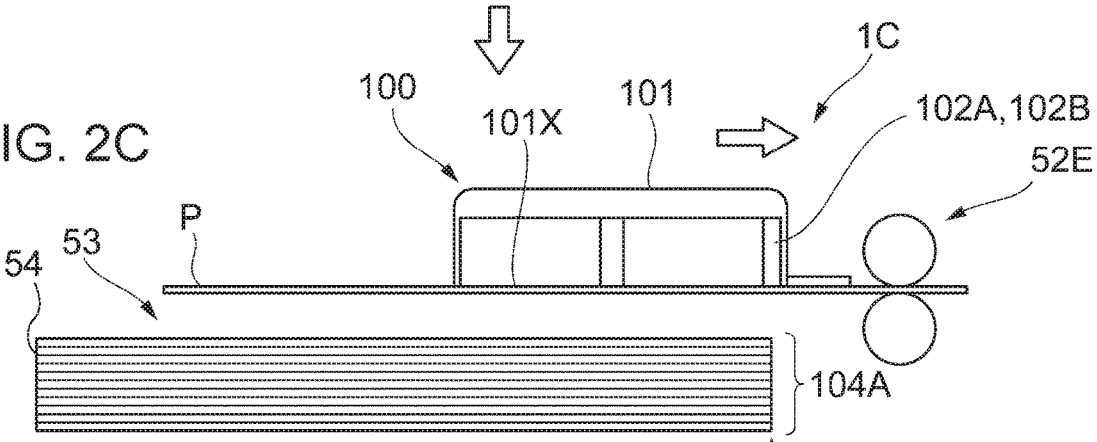

In the present exemplary embodiment, the suction unit 100 then moves toward the upstreammost transport roller 52E as illustrated in FIG. 2C, whereby the sheet P attracted to the lower surface 101X of the unit body 101 is supplied to the upstreammost transport roller 52E.

Hence, the upstreammost transport roller 52E starts to transport the sheet P.

In the present exemplary embodiment, the suction unit 100 moves in a direction intersecting the vertical direction and toward the upstreammost transport roller 52E.

Therefore, the sheet P attracted to the lower surface 101X of the unit body 101 is moved in the direction intersecting the vertical direction and is supplied to the upstreammost transport roller 52E. Hence, the upstreammost transport roller 52E starts to transport the sheet P.

In the present exemplary embodiment, as the suction unit 100 moves toward the upstreammost transport roller 52E as illustrated in FIG. 2C, the first leading-end movable member 102A and the second leading-end movable member 102B advance to the outside of a perimeter 104 of the sheet stack 54.

In other words, in a top view of the suction unit 100 and the sheet stack 54 according to the present exemplary embodiment, the first leading-end movable member 102A and the second leading-end movable member 102B advance to the outside of the perimeter 104 of the sheet stack 54.

More specifically, in the present exemplary embodiment, the perimeter 104 of the sheet stack 54 includes a leading-end perimeter 104A as to be described below.

In the present exemplary embodiment, as the suction unit 100 moves toward the upstreammost transport roller 52E, the first leading-end movable member 102A and the second leading-end movable member 102B advance over the leading-end perimeter 104A as illustrated in FIG. 2C.

Figure 2D:
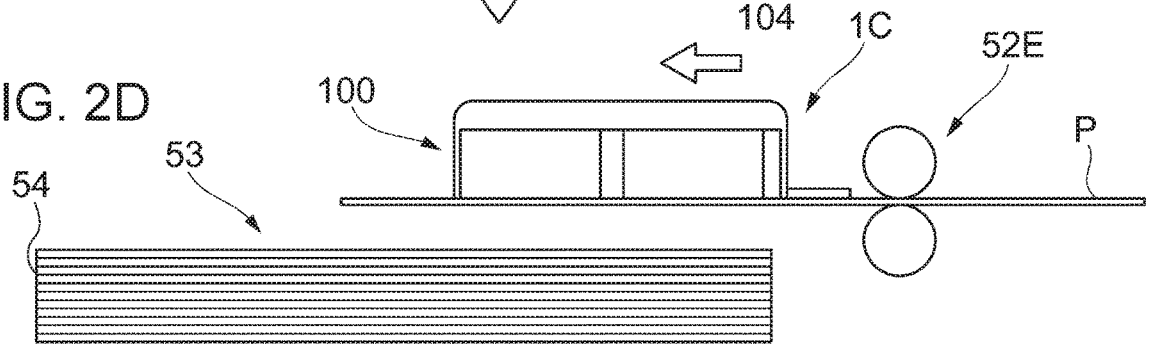

Subsequently, in the present exemplary embodiment, the suction unit 100 returns toward the sheet stack 54 as illustrated in FIG. 2D and is positioned above the sheet stack 54 again.

Figure 4:
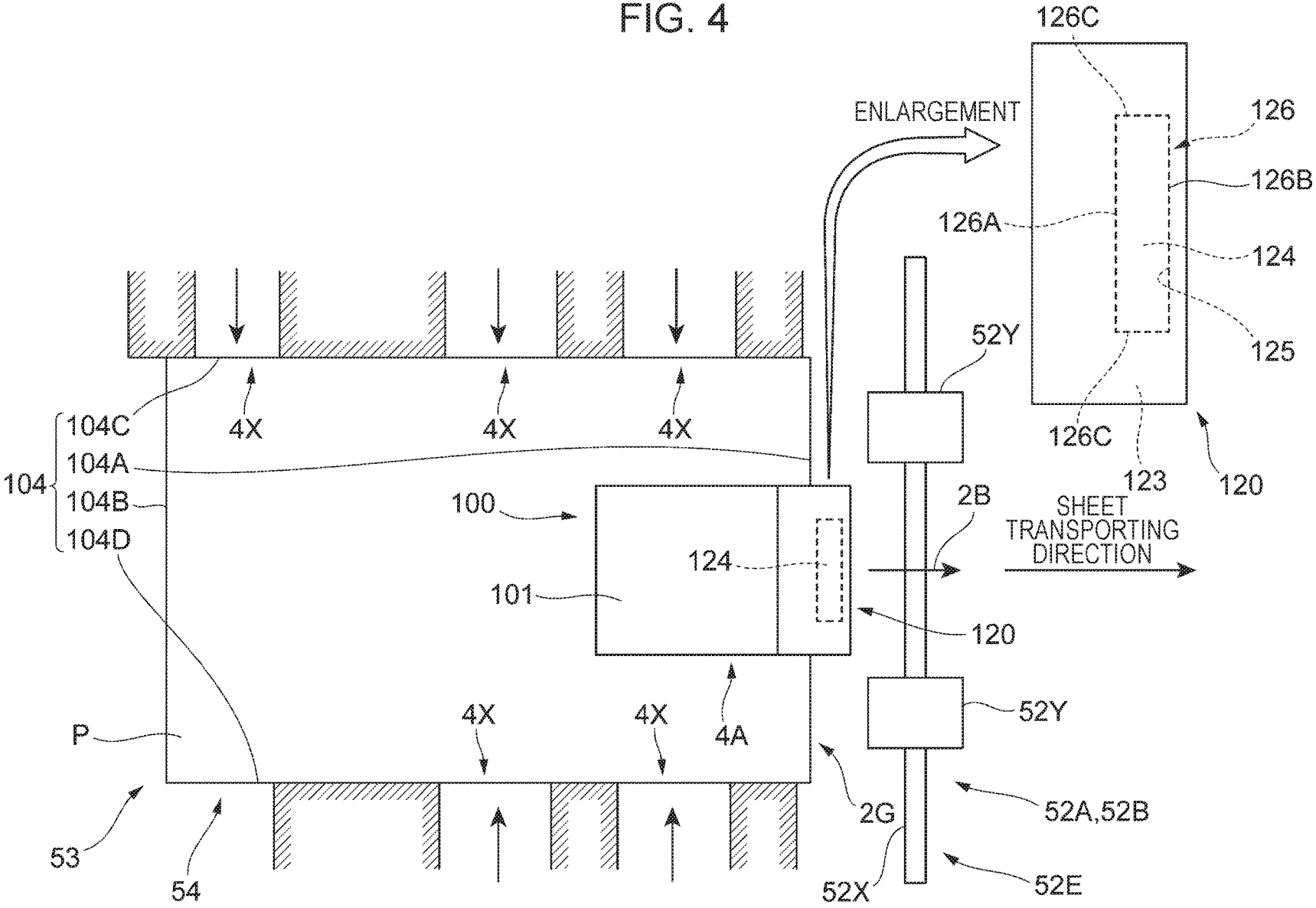
FIG. 4 illustrates a sheet stacking unit and relevant elements seen in a direction of arrow IV illustrated in FIG. 2A.

FIG. 4 illustrates the sheet stacking unit 53 and relevant elements seen in a direction of arrow IV illustrated in FIG. 2A. That is, FIG. 4 is a top view of the sheet stacking unit 53 and relevant elements.

As illustrated in FIG. 4, in the present exemplary embodiment, the sheet stack 54 including a plurality of sheets P stacked in the thickness direction thereof is placed on the sheet stacking unit 53. The sheet stack 54 and the sheets P included in the sheet stack 54 each have the perimeter 104, which has a rectangular shape.

The rectangular perimeter 104 is formed of the leading-end perimeter 104A, a trailing-end perimeter 104B, a first side perimeter 104C, and a second side perimeter 104D.

The leading-end perimeter 104A is a part of the perimeter 104 that is positioned on the downstreammost side in the sheet transporting direction. The leading-end perimeter 104A extends in a direction intersecting (orthogonal to) the sheet transporting direction.

The trailing-end perimeter 104B is a part of the perimeter 104 that is positioned on the upstreammost side in the sheet transporting direction. The trailing-end perimeter 104B also extends in the direction intersecting (orthogonal to) the sheet transporting direction.

The first side perimeter 104C is a part of the perimeter 104 that connects one end of the leading-end perimeter 104A and one end of the trailing-end perimeter 104B. The first side perimeter 104C extends in the sheet transporting direction.

The second side perimeter 104D is a part of the perimeter 104 that connects the other end of the leading-end perimeter 104A and the other end of the trailing-end perimeter 104B. The second side perimeter 104D also extends in the sheet transporting direction.

When a sheet P is suctioned, the unit body 101 of the suction unit 100 is positioned inside the perimeter 104 of the sheet stack 54 as denoted by reference numeral 4A in FIG. 4. Then, to supply the sheet P to the upstreammost transport roller 52E, the suction unit 100 moves toward the upstreammost transport roller 52E as represented by arrow 2B.

In this process according to the present exemplary embodiment, the first leading-end movable member 102A and the second leading-end movable member 102B (see FIG. 3) advance over the leading-end perimeter 104A of the sheet stack 54 as described above.

In the present exemplary embodiment, as illustrated in FIG. 4, a plurality of openings 4X are provided on lateral sides of the sheet stack 54, and air is blown to the sheet stack 54 from the openings 4X. That is, air is also blown from lateral sides of the sheet stack 54.

In the present exemplary embodiment, the driving roller 52A and the follower roller 52B included in the upstreammost transport roller 52E each include a rotating shaft 52X and a plurality of cylindrical members 52Y provided on the rotating shaft 52X.

In the present exemplary embodiment, when the suction unit 100 moves toward the upstreammost transport roller 52E, the suction unit 100 advances into a gap between adjacent two of the cylindrical members 52Y so that the suction unit 100 and the upstreammost transport roller 52E do not interfere with each other.

Referring to FIG. 3 again, the configuration of the suction unit 100 will further be described.

As described above, the suction unit 100 has the unit body 101. The unit body 101 is provided with an air guiding member 120 that guides air.

The air guiding member 120 has a rugged part 121 that makes the leading-end edge 2G (see FIG. 2B) of the sheet P wavy.

The rugged part 121 extends in the direction orthogonal to the sheet transporting direction. That is, the rugged part 121 extends along the leading-end edge 2G of the sheet P.

In the present exemplary embodiment, when the sheet P is attracted to the lower surface 101X of the unit body 101, the leading-end edge 2G of the sheet P is pressed against the rugged part 121 and is thus made to have a wavy shape.

The air guiding member 120 further has suction openings 122 positioned nearer to the lower surface 101X than the rugged part 121. The sheet P attracted to the lower surface 101X is further suctioned through the suction openings 122.

The air guiding member 120 further has an air guiding part 123 that guides the air to be blown to the leading-end edge 2G.

In the present exemplary embodiment, as to be described below, an air supply source such as a fan is provided at a position lower than the lower surface 101X serving as the attracting part. In the present exemplary embodiment, air is first supplied from the position lower than the lower surface 101X toward a position higher than the lower surface 101X.

In the present exemplary embodiment, the air thus supplied upward is guided by the air guiding part 123 to be redirected downward.

In the present exemplary embodiment, a single air guiding member 120 has both the rugged part 121 and the air guiding part 123. That is, in the present exemplary embodiment, the air guiding part 123 is included in the air guiding member 120 having the rugged part 121.

In other words, in the present exemplary embodiment, the rugged part 121 and the air guiding part 123 are both included in a single air guiding member 120.

The air guiding part 123 has a recess 124 that is concave upward.

Specifically, a lower surface 123A of the air guiding part 123 has the recess 124 that is concave upward. The recess 124 has a groove shape. As illustrated in FIG. 4, the recess 124 extends in the direction in which the leading-end edge 2G of the sheet P extends.

More specifically, in the present exemplary embodiment as illustrated in FIG. 4, the lower surface 123A (see FIG. 3) of the air guiding part 123 has a rectangular opening 125, and a space above (vertically above) the opening 125 corresponds to the recess 124 that is concave upward as illustrated in FIG. 3.

In the present exemplary embodiment, as illustrated in FIG. 4, the perimeter of the opening 125 is defined by an opening edge 126. The opening edge 126 has a rectangular shape.

As illustrated in FIG. 4, the opening edge 126 is formed of a sheet-side opening edge 126A, an opposite-side opening edge 126B, and two connecting opening edges 126C.

The sheet-side opening edge 126A extends along the leading-end edge 2G of the sheet P.

The opposite-side opening edge 126B is positioned farther from the leading-end edge 2G of the sheet P than the sheet-side opening edge 126A. The opposite-side opening edge 126B also extends along the leading-end edge 2G of the sheet P.

One of the two connecting opening edges 126C connects one end of the sheet-side opening edge 126A and one end of the opposite-side opening edge 126B.

The other connecting opening edge 126C connects the other end of the sheet-side opening edge 126A and the other end of the opposite-side opening edge 126B.

Figure 5:
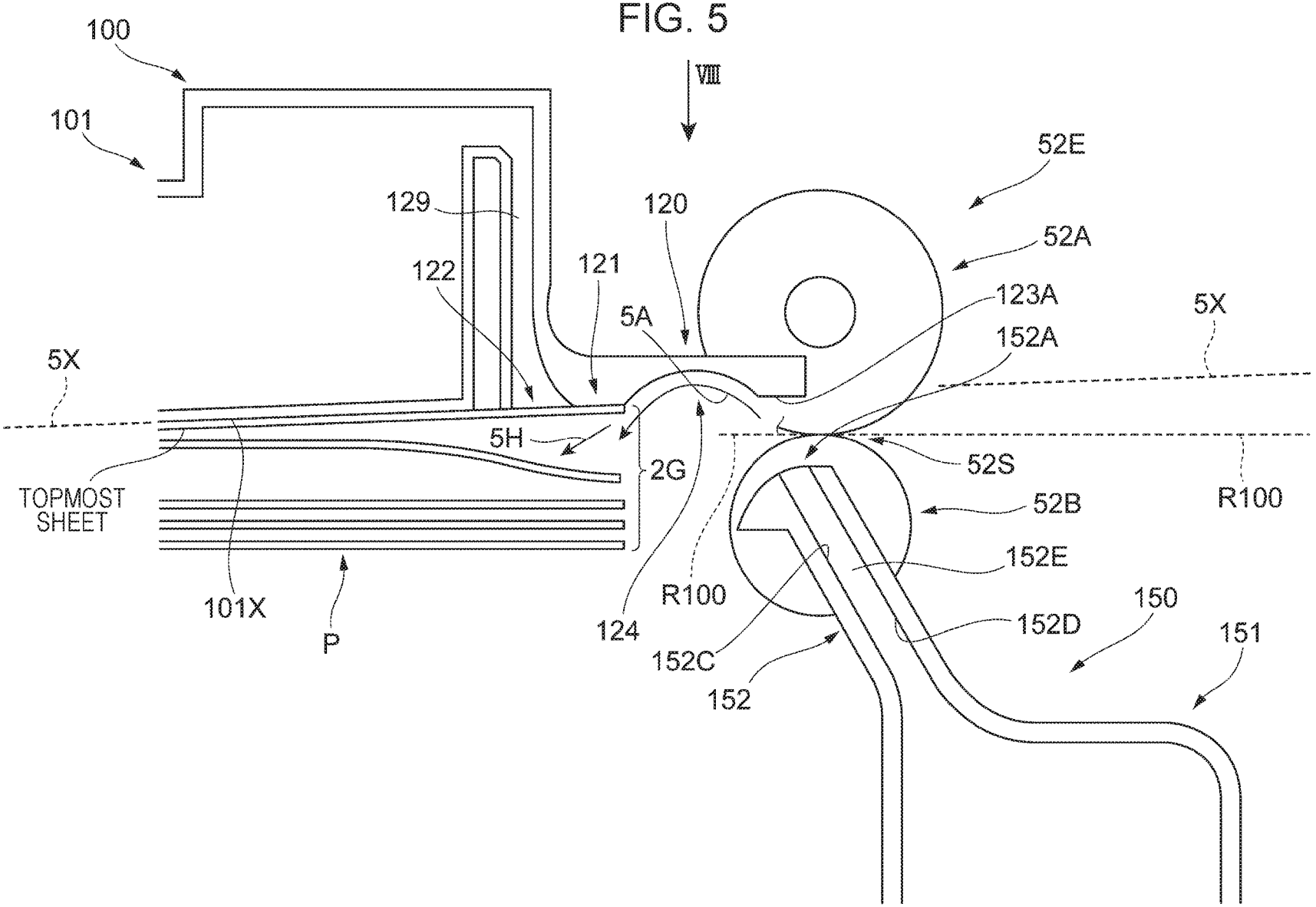
FIG. 5 is a sectional side view of the suction unit and relevant elements.

FIG. 5 is a sectional side view of the suction unit 100 and relevant elements.

In the present exemplary embodiment, although not described above, an air supply unit 150 that supplies air to be blown to the leading-end edge 2G is provided as illustrated in FIG. 5.

The air supply unit 150 includes an air supply source 151 such as a fan, and a tube 152 that guides the air sent from the air supply source 151 to flow obliquely upward.

The air supply source 151 and the tube 152 are positioned lower than the lower surface 101X of the unit body 101.

The tube 152 has a discharge port 152A at the tip thereof. The air to be blown toward the recess 124 provided in the air guiding member 120 is discharged from the discharge port 152A.

The tube 152 further has a first inner wall surface 152C and a second inner wall surface 152D that are opposite each other. The tube 152 further has a third inner wall surface 152E and a fourth inner wall surface (not illustrated) that each connect the first inner wall surface 152C and the second inner wall surface 152D. In the present exemplary embodiment, the first inner wall surface 152C is nearer to the sheet P than the second inner wall surface 152D.

In the present exemplary embodiment, as represented by arrow 5A, air flowing from the position lower than the lower surface 101X of the unit body 101 is first directed to a position higher than the lower surface 101X and is then redirected downward to be blown to the leading-end edge 2G from the position higher than the lower surface 101X.

In other words, in the present exemplary embodiment, air flowing from a position lower than an extension plane 5X, which is an extension of the lower surface 101X, is first directed toward the upper side with respect to the extension plane 5X and is then redirected toward the lower side with respect to the extension plane 5X to be blown to the leading-end edge 2G.

That is, in the present exemplary embodiment, air is first guided upward by the tube 152 and then guided downward. In the present exemplary embodiment, the air thus guided downward is blown to the leading-end edge 2G of the sheet P.

In the present exemplary embodiment, the lower surface 123A of the air guiding member 120 included in the sheet transporting device 1B (see FIG. 1) is used to cause the air flowing from the position lower than the lower surface 101X of the unit body 101 to be redirected downward. The air thus redirected downward is blown to the leading-end edge 2G of the sheet P.

In the present exemplary embodiment, the discharge port 152A is positioned lower than a contact part 52S defined between the driving roller 52A and the follower roller 52B included in the upstreammost transport roller 52E.

In the present exemplary embodiment, air flowing through the tube 152 is discharged from the discharge port 152A positioned at the tip of the tube 152, and the discharge port 152A is positioned lower than the contact part 52S defined between the driving roller 52A and the follower roller 52B.

In the present exemplary embodiment, the tube 152 that guides the air flowing upward does not cross a sheet transport path R100. Specifically, in the present exemplary embodiment, the discharge port 152A of the tube 152 is positioned lower than the sheet transport path R100.

Therefore, in the present exemplary embodiment, only air crosses the sheet transport path R100. More specifically, in the present exemplary embodiment, the tube 152 does not cross the sheet transport path R100 but only the air to be blown to the leading-end edge 2G crosses the sheet transport path R100.

In the present exemplary embodiment, the air having crossed the sheet transport path R100 flows toward the recess 124, and the recess 124 guides the air. The air thus guided is blown to the leading-end edge 2G.

In the present exemplary embodiment, the air blown from the upper side is directed obliquely downward to the leading-end edge 2G as represented by arrow 5H. Thus, the air directed obliquely downward is blown to the leading-end edge 2G.

Specifically, in the present exemplary embodiment, air is sent obliquely downward from a position higher than and away from the leading-end edge 2G of the sheet P attracted to the lower surface 101X and is thus blown to the leading-end edge 2G.

More specifically, in the present exemplary embodiment, air is sent obliquely downward and toward the leading-end edge 2G from a position farther from the lower surface 101X than the leading-end edge 2G of the topmost sheet P and from a position higher than the lower surface 101X. In such a manner, the air is blown to the leading-end edge 2G of the sheet P attracted to the lower surface 101X.

Air that is sent obliquely downward as described above is more likely to flow into gaps between the sheets P as represented by arrow 5H than in a case where air is sent vertically downward.

In the present exemplary embodiment, each of the sheets P stacked on the sheet stacking unit 53 is transported as follows. First, as illustrated in FIGS. 2A and 2B, one sheet P is picked up by attracting the topmost sheet P in the sheet stack 54 to the suction unit 100.

In other words, a sheet P at the top of the sheet stack 54 is attracted to the suction unit 100, whereby one sheet P is picked up.

Subsequently, in the present exemplary embodiment, the suction unit 100 to which the sheet P is being attracted moves toward the upstreammost transport roller 52E, whereby the sheet P attracted to the suction unit 100 is supplied to the upstreammost transport roller 52E.

In the present exemplary embodiment, the suction unit 100 does not move up and down when picking up a sheet P (when the suction unit 100 suctions a sheet P). Alternatively, the suction unit 100 may be lowered to pick up a sheet P and be lifted up after the sheet P is attracted to the suction unit 100.

If, for example, the sheets P are sticking together with a large force, the second and subsequent sheets P that are present below the topmost sheet P attracted to the suction unit 100 may remain sticking to the topmost sheet P. In such a situation, a plurality of sheets P may be supplied to the upstreammost transport roller 52E, which is so-called multiple feeding.

In the present exemplary embodiment, to suppress the occurrence of multiple feeding, air is blown to the leading-end edge 2G from the upper side as described above.

In the present exemplary embodiment, a combination of the air supply unit 150 and the air guiding member 120 serves as a blowing device, with which air is blown to the leading-end edge 2G from a position higher than the lower surface 101X of the unit body 101.

In the present exemplary embodiment, as illustrated in FIG. 4, air is also blown to the sheet stack 54 from lateral sides of the sheet stack 54 so as to suppress the sticking between the sheets P.

If air is blown to the sheet stack 54 from lateral sides of the sheet stack 54, the individual sheets P tend to float and move upward. Consequently, the second and subsequent sheets P are likely to stick to the topmost sheet P attracted to the suction unit 100.

In contrast, if air is blown from the upper side as in the present exemplary embodiment, the air tends to flow into the gap between the topmost sheet P and the second and subsequent sheets P.

Referring to FIG. 5, the air guiding member 120 will further be described.

As illustrated in FIG. 5, the air guiding member 120 has the suction openings 122 positioned nearer to the lower surface 101X than the rugged part 121. The sheet P attracted to the lower surface 101X is further suctioned through the suction openings 122.

In the present exemplary embodiment, after the sheet P is attracted to the lower surface 101X, suction of the sheet P through the suction openings 122 is started.

In the present exemplary embodiment, as illustrated in FIG. 5, the suction openings 122 are connected to the inside of the unit body 101 through a connecting path 129. The inside of the connecting path 129 is to be depressurized. Referring to FIG. 3, the width (the size in the direction in which the leading-end edge 2G extends) of the connecting path 129 gradually increases toward the lower side.

In the present exemplary embodiment, before the sheet P is attracted to the lower surface 101X, there is a gap between the sheet P and the suction openings 122. Therefore, suction of the sheet P through the suction openings 122 is not performed.

When the sheet P is attracted to the lower surface 101X, the gap between the sheet P and the suction openings 122 is eliminated, and the sheet P is suctioned through the suction openings 122.

When the sheet P is suctioned through the suction openings 122, the leading-end edge 2G of the sheet P is urged and pressed against the rugged part 121. Thus, the leading-end edge 2G comes to have a rugged shape. In other words, the leading-end edge 2G comes to have a wavy shape (as to be described below).

Figure 6:
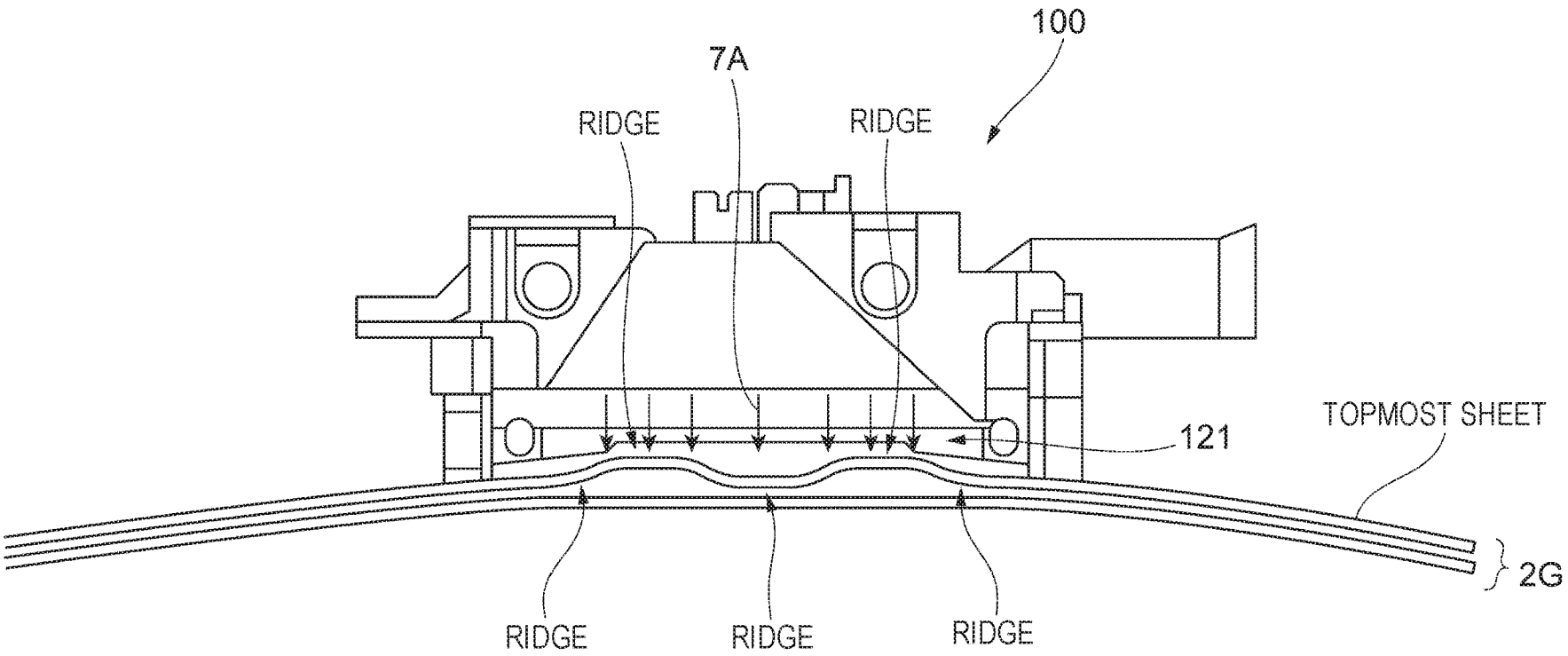
FIG. 6 illustrates the suction unit seen in a direction of arrow VI illustrated in FIG. 2B.

FIG. 6 illustrates the suction unit 100 seen in a direction of arrow VI illustrated in FIG. 2B.

In the present exemplary embodiment, as represented by arrows 7A, air is blown toward the leading-end edge 2G from the upper side of the leading-end edge 2G. Specifically, the air is blown to a part of the leading-end edge 2G that has the wavy shape.

More specifically, in the present exemplary embodiment, the leading-end edge 2G of the sheet P is pressed against the rugged part 121 and thus comes to have a wavy shape.

In the present exemplary embodiment, the air is blown to the wavy-shaped part from the upper side.

Therefore, compared to a case where air is blown to a part of the sheet P that does not have a wavy shape, air is more likely to flow into the gap between the topmost sheet P attracted to the suction unit 100 and the second and subsequent sheets P sticking to the topmost sheet P.

Herein, the term "wavy shape" refers to a shape in which first ridges each projecting from one side of the sheet P toward the other side in the thickness direction of the sheet P and second ridges each projecting from the other side of the sheet P toward the one side in the thickness direction of the sheet P are positioned alternately in the direction in which the leading-end edge 2G extends.

The numbers of first ridges and second ridges are not specifically limited. A shape formed of one first ridge and one second ridge that are positioned side by side is also regarded as a wavy shape.

Figure 7:
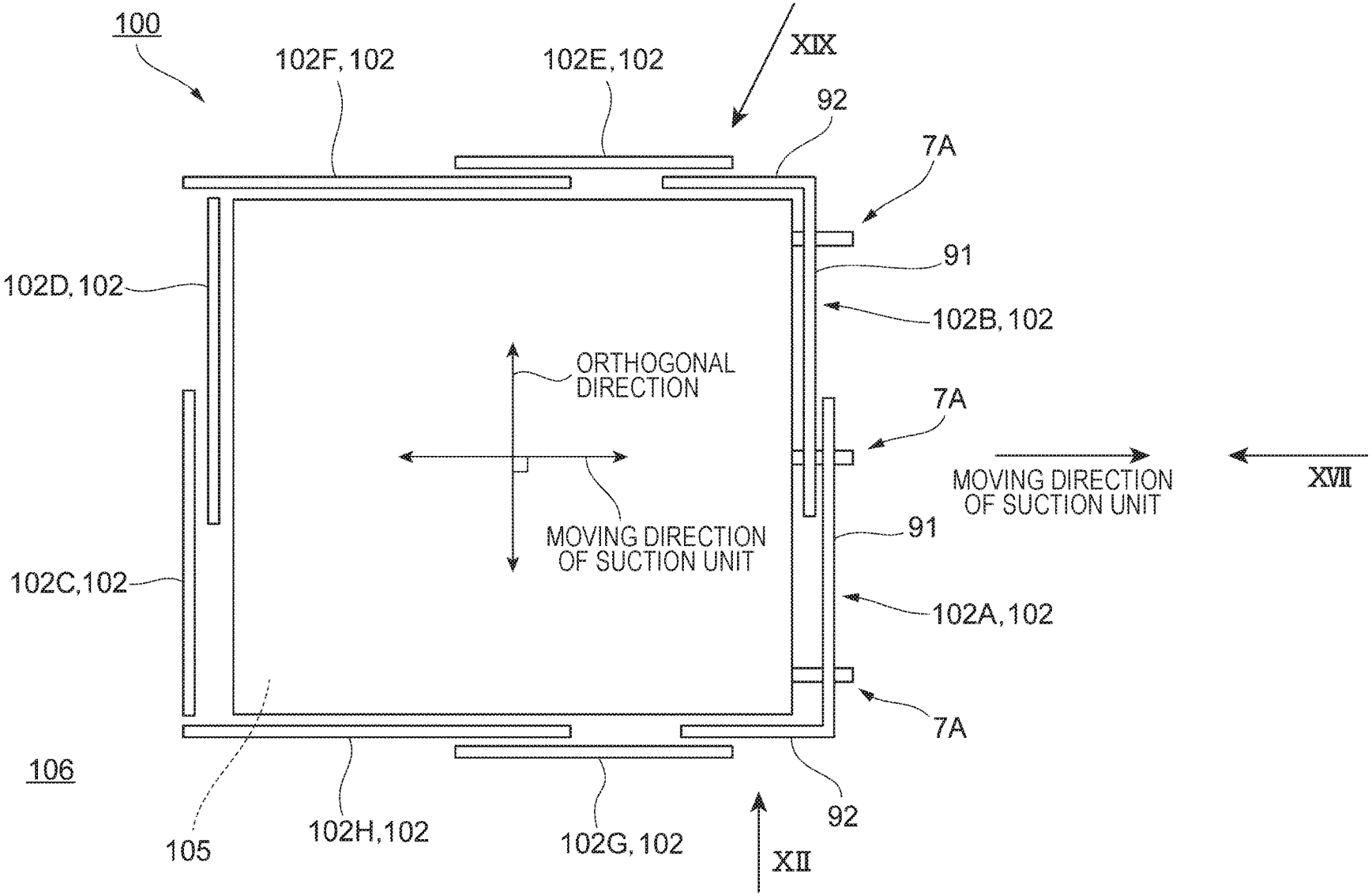
FIG. 7 illustrates the suction unit seen from vertically above.

FIG. 7 illustrates the suction unit 100 seen from vertically above. In FIG. 7, the air guiding member 120 and an attaching member 500, which will be described below, are not illustrated.

Figure 8B:
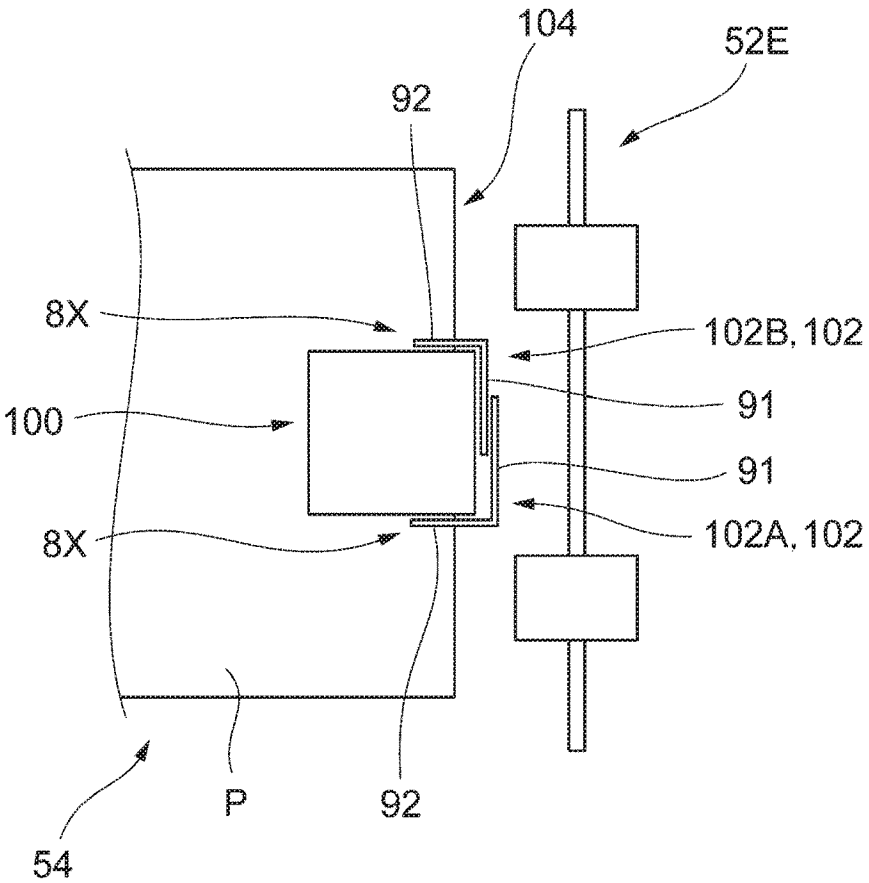
FIGS. 8A and 8B illustrate how the suction unit moves.
Figure 8A:
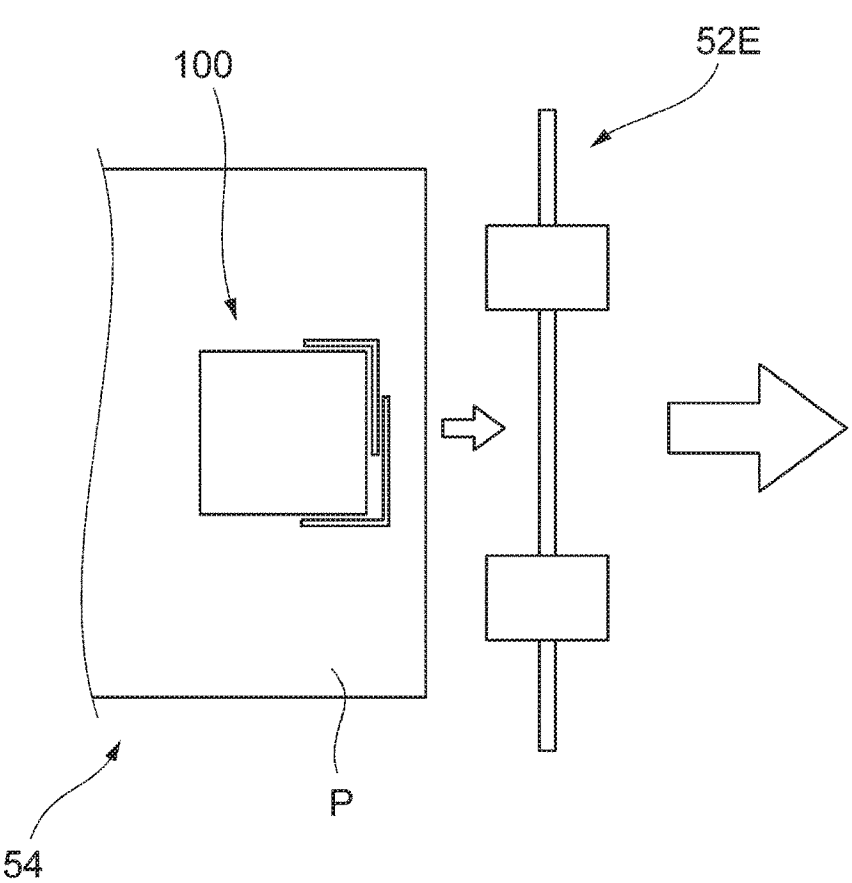

FIGS. 8A and 8B illustrate how the suction unit 100 moves. In FIGS. 8A and 8B, the air guiding member 120, the attaching member 500, and the movable members 102 other than the first leading-end movable member 102A and the second leading-end movable member 102B are not illustrated.

FIG. 8A illustrates a state before the suction unit 100 moves toward the upstreammost transport roller 52E. FIG. 8B illustrates a state after the suction unit 100 has moved toward the upstreammost transport roller 52E.

In the present exemplary embodiment, the first leading-end movable member 102A and the second leading-end movable member 102B seen from vertically above as in FIG. 7 each have an L shape including a first segment 91 and a second segment 92 that intersect each other.

In the present exemplary embodiment, the first segment 91 and the second segment 92 are orthogonal to each other.

In the present exemplary embodiment, when the first leading-end movable member 102A and the second leading-end movable member 102B move up and down, the first leading-end movable member 102A and the second leading-end movable member 102B are guided by guiding parts denoted by reference numeral 7A.

Note that the other movable members 102 are also guided by other guiding parts, which are not illustrated in FIG. 7.

The first segments 91 each extend in a direction orthogonal to the direction in which the suction unit 100 moves (hereinafter referred to as "moving direction of the suction unit 100"). The second segments 92 each extend in the moving direction of the suction unit 100.

In the present exemplary embodiment, as illustrated in FIG. 8B, as the suction unit 100 moves toward the upstreammost transport roller 52E, the first segments 91 advance to the outside of the perimeter 104 of the sheet stack 54.

Specifically, in the present exemplary embodiment, when the suction unit 100 has moved toward the upstreammost transport roller 52E, a part of the first leading-end movable member 102A and a part of the second leading-end movable member 102B are positioned outside the perimeter 104 of the sheet stack 54.

On the other hand, as represented by reference numeral 8X in FIG. 8B, another part of the first leading-end movable member 102A and another part of the second leading-end movable member 102B extend from the outside to the inside of the perimeter 104 of the sheet stack 54 and are therefore supported by the sheet stack 54 from below.

More specifically, the second segments 92 each extend from the outside to the inside of the perimeter 104 of the sheet stack 54. That is, a part of each of the second segments 92 is positioned inside the perimeter 104. Therefore, the second segments 92 are supported by the sheet stack 54 from below.

In the present exemplary embodiment, since the second segments 92 are supported by the sheet stack 54 from below, the first segments 91 each being a part that advances to the outside of the perimeter 104 are restricted from moving downward.

In other words, in the present exemplary embodiment, since the second segments 92 are supported by the sheet stack 54 from below, the first leading-end movable member 102A and the second leading-end movable member 102B are restricted from moving downward.

Unlike the above case, it is possible to form a first leading-end movable member 102A and a second leading-end movable member 102B each including, for example, only the first segment 91.

In that case, however, when the first segments 91 advance to the outside of the perimeter 104 of the sheet stack 54, the first leading-end movable member 102A and the second leading-end movable member 102B move downward.

Specifically, when the first segments 91 are positioned outside the perimeter 104 of the sheet stack 54 and the sheets P that should support the first segments 91 from below are not present below the first segments 91, the first leading-end movable member 102A and the second leading-end movable member 102B move downward.

In other words, if no sheets P are in contact with the lower ends of the first segments 91, the first leading-end movable member 102A and the second leading-end movable member 102B move downward.

More specifically, if the suction of a sheet P with the suction unit 100 fails, the suction unit 100 may move toward the upstreammost transport roller 52E with no sheet P being present below the first leading-end movable member 102A and the second leading-end movable member 102B.

In other words, the suction unit 100 may move toward the upstreammost transport roller 52E with no sheet P being in contact with the lower ends of the first leading-end movable member 102A and the second leading-end movable member 102B.

In such a configuration, when the first segments 91 are positioned outside the perimeter 104 of the sheet stack 54, no sheet P is present below the first segments 91. Therefore, the first segments 91 move to positions lower than the upper surface of the sheet stack 54.

In other words, in the above situation, no sheet P is in contact with the lower ends of the first segments 91. Therefore, if the first leading-end movable member 102A and the second leading-end movable member 102B each include only the first segment 91, the first leading-end movable member 102A and the second leading-end movable member 102B move to positions lower than the upper surface of the sheet stack 54.

Such a situation may damage some sheets P and/or the first leading-end movable member 102A and the second leading-end movable member 102B as to be described below.

In contrast, in a configuration employing a functional part, such as the second segments 92 according to the present exemplary embodiment, interlocked with the first segments 91 and extending from the outside to the inside of the perimeter 104 of the sheet stack 54, the functional part rests on the sheet stack 54 and is therefore supported by the sheet stack 54 from below.

In such a configuration, even if no sheet P is present below the first segments 91, the first segments 91 positioned outside the perimeter 104 are restricted from moving downward.

In other words, even if no sheet P is in contact with the lower ends of the first segments 91, the first segments 91 positioned outside the perimeter 104 are restricted from moving downward.

The second segments 92 according to the present exemplary embodiment not only rest on the sheet stack 54 but also have a function of separating the depressurized space 105 from the atmospheric space 106 by being positioned between the depressurized space 105 and the atmospheric space 106 as illustrated in FIG. 7.

The second segments 92 according to the present exemplary embodiment are each also regarded as an interlocked part that is interlocked with a corresponding one of the first segments 91 that advances to the outside of the perimeter 104 of the sheet stack 54.

Specifically, when the suction unit 100 according to the present exemplary embodiment supplies a sheet P to the upstreammost transport roller 52E, the suction unit 100 moves in one direction denoted by arrow 2B in FIG. 4.

In the present exemplary embodiment, the first segments 91 of the first leading-end movable member 102A and the second leading-end movable member 102B (see FIG. 7) are positioned on the downstream side with respect to the depressurized space 105 in the one direction (the moving direction of the suction unit 100).

In the present exemplary embodiment, the second segments 92 are interlocked with the first segments 91 as described above.

When the first segments 91 having moved toward the downstream side in the one direction are positioned outside the perimeter 104 of the sheet stack 54 (see FIG. 8B), a part of each of the second segments 92 is positioned inside the perimeter 104. Therefore, the first segments 91 are restricted from moving downward.

Specifically, the second segments 92, each being an exemplary interlocked part, not only move toward the downstream side in the one direction with the movement of the first segments 91 toward the downstream side in the one direction but also move up and down with the up-and-down movement of the first segment 91.

In the present exemplary embodiment, the second segments 92 are positioned inside the perimeter 104 of the sheet stack 54. Therefore, when the second segments 92 are restricted by the sheet stack 54 from moving downward, the first segments 91 are also restricted from moving downward.

The first segments 91 according to the present exemplary embodiment are each also regarded as a plate-shaped movable member. In the present exemplary embodiment, the plate-shaped movable member is positioned on the downstream side with respect to the depressurized space 105 in the one direction. The plate-shaped movable member extends in a direction intersecting (orthogonal to) the one direction.

The first segments 91 according to the present exemplary embodiment are each also regarded as a plate-shaped member including a projecting part projecting in a direction intersecting the direction in which the first segment 91 extends. That is, the second segments 92 according to the present exemplary embodiment each correspond to the projecting part. The second segments 92 each project from the point of connection to the first segment 91 and in a direction opposite to the one direction.

Specifically, the second segments 92 extend in the direction opposite to the one direction corresponding to the direction in which the suction unit 100 moves.

More specifically, in the present exemplary embodiment, the first leading-end movable member 102A and the second leading-end movable member 102B including the respective second segments 92 each have a configuration including a part extending in the direction opposite to the one direction in which the suction unit 100 moves.

The above description concerns a case where the first leading-end movable member 102A and the second leading-end movable member 102B each have an L shape.

Figure 9:
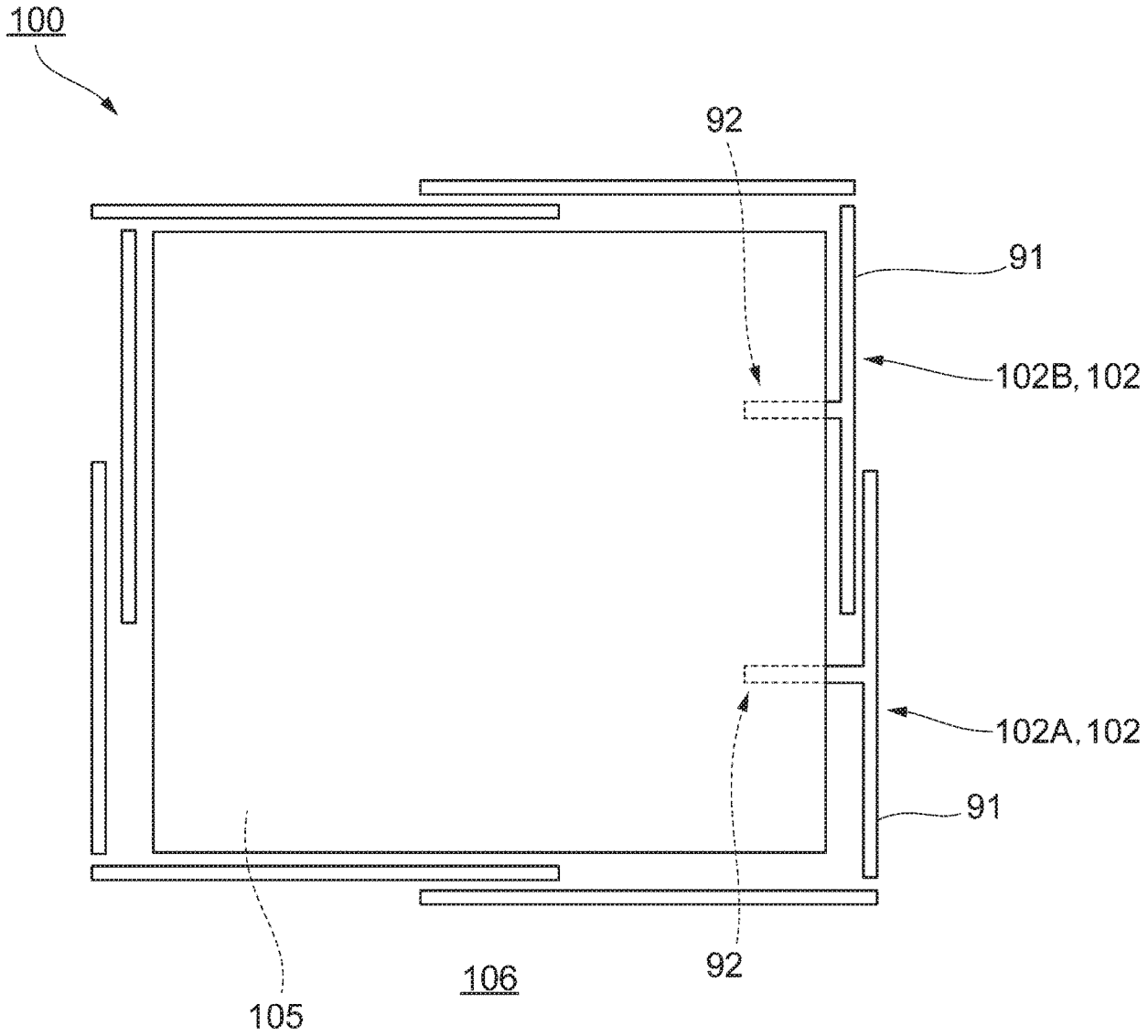
FIG. 9 illustrates another configuration of the suction unit.

The shape of each of the first leading-end movable member 102A and the second leading-end movable member 102B is not limited to the L shape and may be, for example, a T shape as illustrated in FIG. 9 (a diagram illustrating another configuration of the suction unit 100).

In the configuration illustrated in FIG. 9, the second segments 92 are each connected to a corresponding one of the first segments 91 at a position between one end and the other end of the first segment 91 in the long-side direction. When the second segment 92 is on the sheet stack 54 (not illustrated in FIG. 9), the second segment 92 extends from the point of connection to the first segment 91 toward the inside of the perimeter 104 of the sheet stack 54.

In such a configuration, the second segment 92 does not have the function of separating the depressurized space 105 from the atmospheric space 106 but restricts a corresponding one of the first leading-end movable member 102A and the second leading-end movable member 102B from moving downward.

The second segment 92 may be integrated with the first segment 91 or provided separately from the first segment 91. In the latter case, the second segment 92 may be fixed to the first segment 91 with adhesive or the like.

Figure 10:
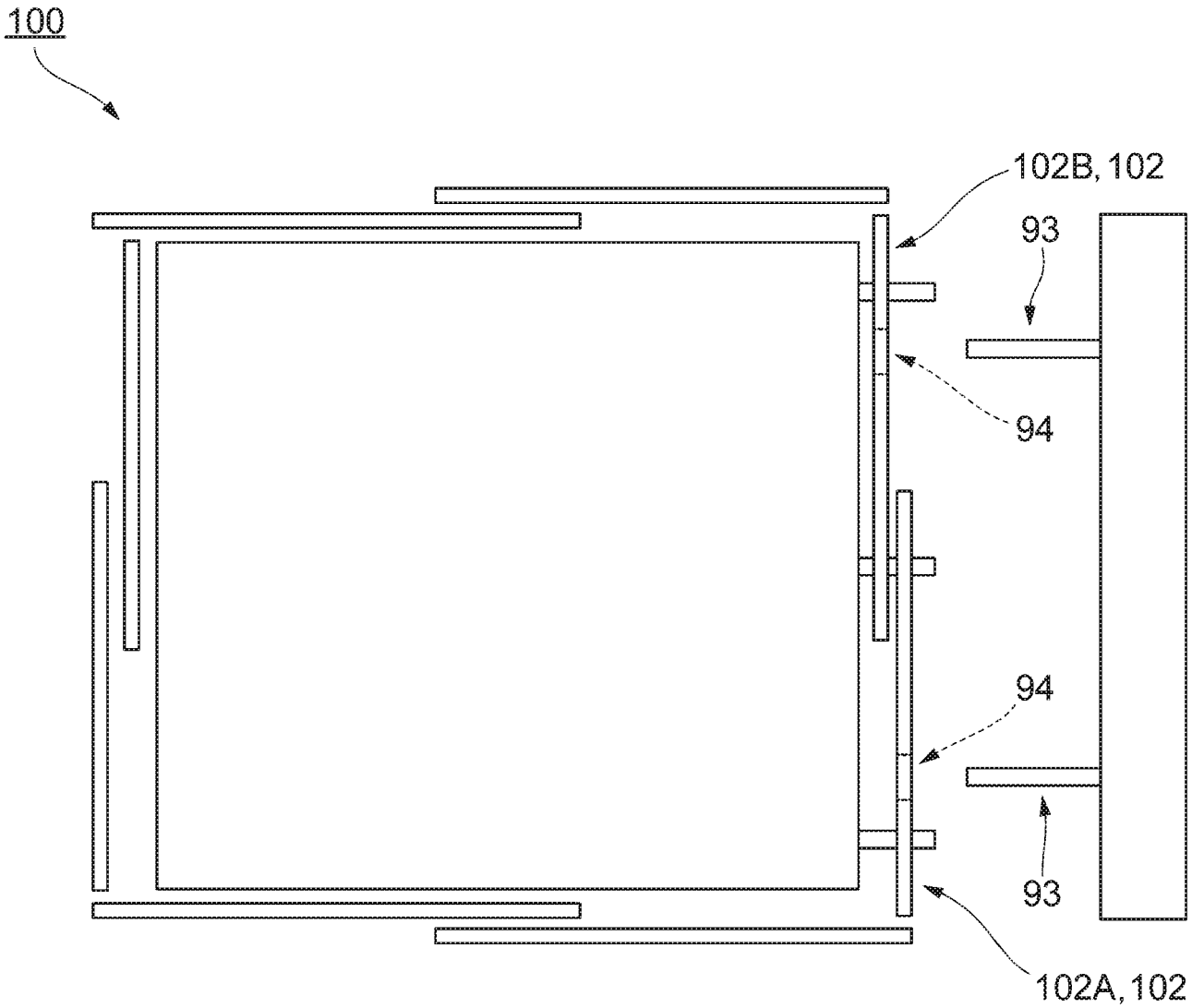
FIG. 10 illustrates yet another configuration of the suction unit.

Alternatively, the downward movement of the first leading-end movable member 102A and the second leading-end movable member 102B may be restricted by employing a configuration illustrated in FIG. 10 (a diagram illustrating yet another configuration of the suction unit 100).

In the configuration illustrated in FIG. 10, the body of the image forming apparatus 1 (see FIG. 1) has restricting projections 93 that restrict the first leading-end movable member 102A and the second leading-end movable member 102B from moving downward, respectively.

In the configuration illustrated in FIG. 10, the first leading-end movable member 102A and the second leading-end movable member 102B each have a flat plate shape with a through-hole 94 into which a corresponding one of the restricting projections 93 is to be inserted.

In the configuration illustrated in FIG. 10, before the first leading-end movable member 102A and the second leading-end movable member 102B advance over the perimeter 104 of the sheet stack 54, the restricting projections 93 go into the respective through-holes 94 provided in the first leading-end movable member 102A and the second leading-end movable member 102B.

In such a configuration, when the first leading-end movable member 102A and the second leading-end movable member 102B advance over the perimeter 104 of the sheet stack 54 and are about to move downward, the restricting projections 93 restrict the first leading-end movable member 102A and the second leading-end movable member 102B from moving downward.

In the configuration illustrated in FIG. 10, the entirety of each of the first leading-end movable member 102A and the second leading-end movable member 102B advances to the outside of the perimeter 104 of the sheet stack 54.

Therefore, in such a configuration, the downward movement of the first leading-end movable member 102A and the second leading-end movable member 102B is restricted by using the restricting projections 93, which are different from the first leading-end movable member 102A and the second leading-end movable member 102B, instead of using a part of each of the first leading-end movable member 102A and the second leading-end movable member 102B.

On the other hand, in the configurations illustrated in FIGS. 7 and 9, a part of each of the first leading-end movable member 102A and the second leading-end movable member 102B advances to the outside of the perimeter 104 of the sheet stack 54, whereas the other part remains inside the perimeter 104 of the sheet stack 54.

In the configurations illustrated in FIGS. 7 and 9, the part that remains inside the perimeter 104 of the sheet stack 54 is used to restrict the downward movement of the first leading-end movable member 102A and the second leading-end movable member 102B.

To summarize, in the present exemplary embodiment, a part of the first leading-end movable member 102A and a part of the second leading-end movable member 102B or the restricting projections 93 serve as restricting parts, and the restricting parts restrict the downward movement of the first leading-end movable member 102A and the second leading-end movable member 102B, respectively.

More specifically, in the present exemplary embodiment, a part of the first leading-end movable member 102A and a part of the second leading-end movable member 102B or the restricting projections 93 restrict the downward movement of a part of the first leading-end movable member 102A and a part of the second leading-end movable member 102B that advance to the outside of the perimeter 104 (hereinafter the parts are each referred to as "outside advancing part").

In the present exemplary embodiment illustrated in FIGS. 7 and 9, a part of the first leading-end movable member 102A and a part of the second leading-end movable member 102B are supported by the sheet stack 54 from below. Therefore, the downward movement of the outside advancing parts that are not supported by the sheets P from below is restricted.

In other words, in the present exemplary embodiment, since a part of the first leading-end movable member 102A and a part of the second leading-end movable member 102B are supported by the sheet stack 54 from below, the downward movement of the outside advancing parts that are not in contact with the sheets P at the lower ends thereof is restricted.

To summarize, in the present exemplary embodiment, the outside advancing parts are supported by the sheet stack 54 (the sheets P) with the aid of the second segment 92 resting on the sheet stack 54 but are not in contact with the sheets P at the lower ends thereof. That is, in the present exemplary embodiment, the outside advancing parts are not directly supported by the sheets P.

According to the present exemplary embodiment, the downward movement of such outside advancing parts, which are not in contact with the sheets P and are not directly supported by the sheets P from below, is restricted.

Figure 11A:
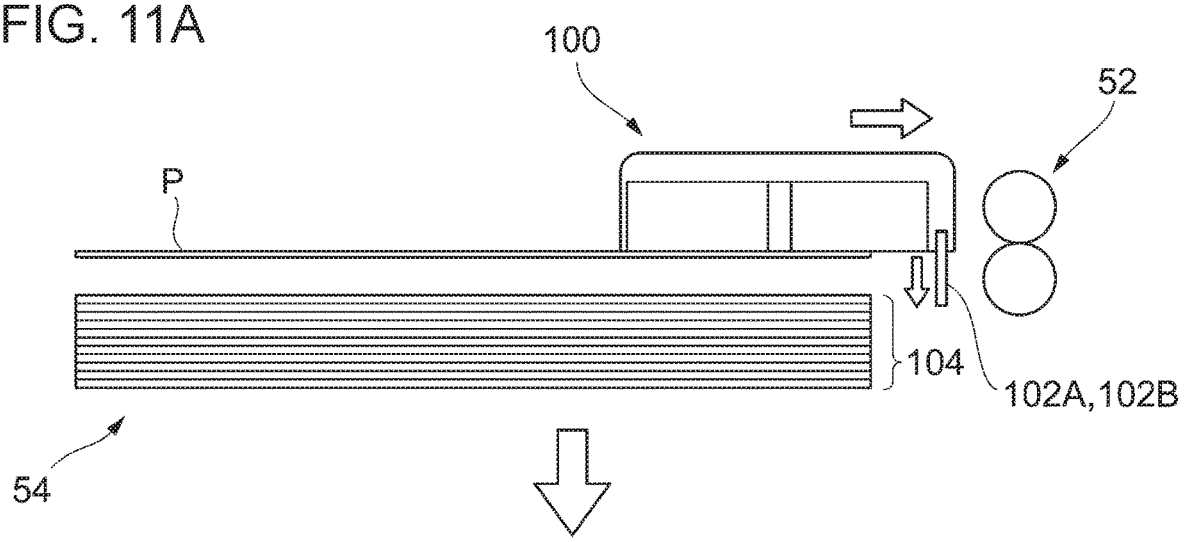
FIGS. 11A and 11B illustrate a comparative embodiment.
Figure 11B:
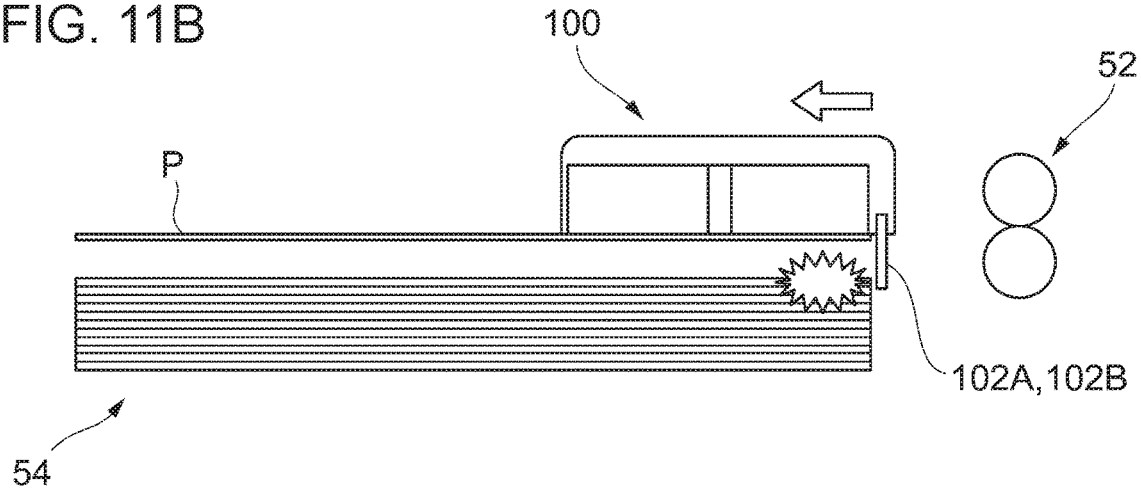

FIGS. 11A and 11B illustrate a comparative embodiment. In the comparative embodiment, the first leading-end movable member 102A and the second leading-end movable member 102B each include only a segment corresponding to the first segment 91, with no segment corresponding to the second segment 92.

Specifically, in the comparative embodiment, the first leading-end movable member 102A and the second leading-end movable member 102B each have a flat plate shape and extend in the direction orthogonal to the moving direction of the suction unit 100.

In such a configuration, when the suction unit 100 moves toward the upstreammost transport roller 52E, as illustrated in FIG. 11A, the entirety of each of the first leading-end movable member 102A and the second leading-end movable member 102B advances to the outside of the perimeter 104 of the sheet stack 54.

Specifically, when the suction unit 100 and the sheet stack 54 are viewed from above, the entirety of each of the first leading-end movable member 102A and the second leading-end movable member 102B is positioned outside the perimeter 104.

In such a situation, if no sheet P is present at a position below the suction unit 100 where a sheet P should be, the first leading-end movable member 102A and the second leading-end movable member 102B move downward.

Specifically, if the suction of the sheet P with the suction unit 100 fails, the first leading-end movable member 102A and the second leading-end movable member 102B move downward with no sheet P supporting the movable members 102 from below.

If the suction unit 100 moves back toward the sheet stack 54 with the first leading-end movable member 102A and the second leading-end movable member 102B lowered as illustrated in FIG. 11B, the first leading-end movable member 102A and the second leading-end movable member 102B interfere with the sheet stack 54.

Such a situation may damage some sheets P included in the sheet stack 54 and/or the first leading-end movable member 102A and the second leading-end movable member 102B.

In contrast, if the second segments 92 or the restricting projections 93 described above are employed, the downward movement of the first leading-end movable member 102A and the second leading-end movable member 102B is restricted even if the first leading-end movable member 102A and the second leading-end movable member 102B are not supported by any sheet P from below.

Note that supporting parts (not illustrated) that support the first leading-end movable member 102A and the second leading-end movable member 102B from below may be provided outside the perimeter 104 of the sheet stack 54.

In such a configuration, when the first leading-end movable member 102A and the second leading-end movable member 102B advance over the perimeter 104, the supporting parts support the first leading-end movable member 102A and the second leading-end movable member 102B from below. Therefore, in such a configuration as well, the downward movement of the first leading-end movable member 102A and the second leading-end movable member 102B is restricted.

Figure 12:
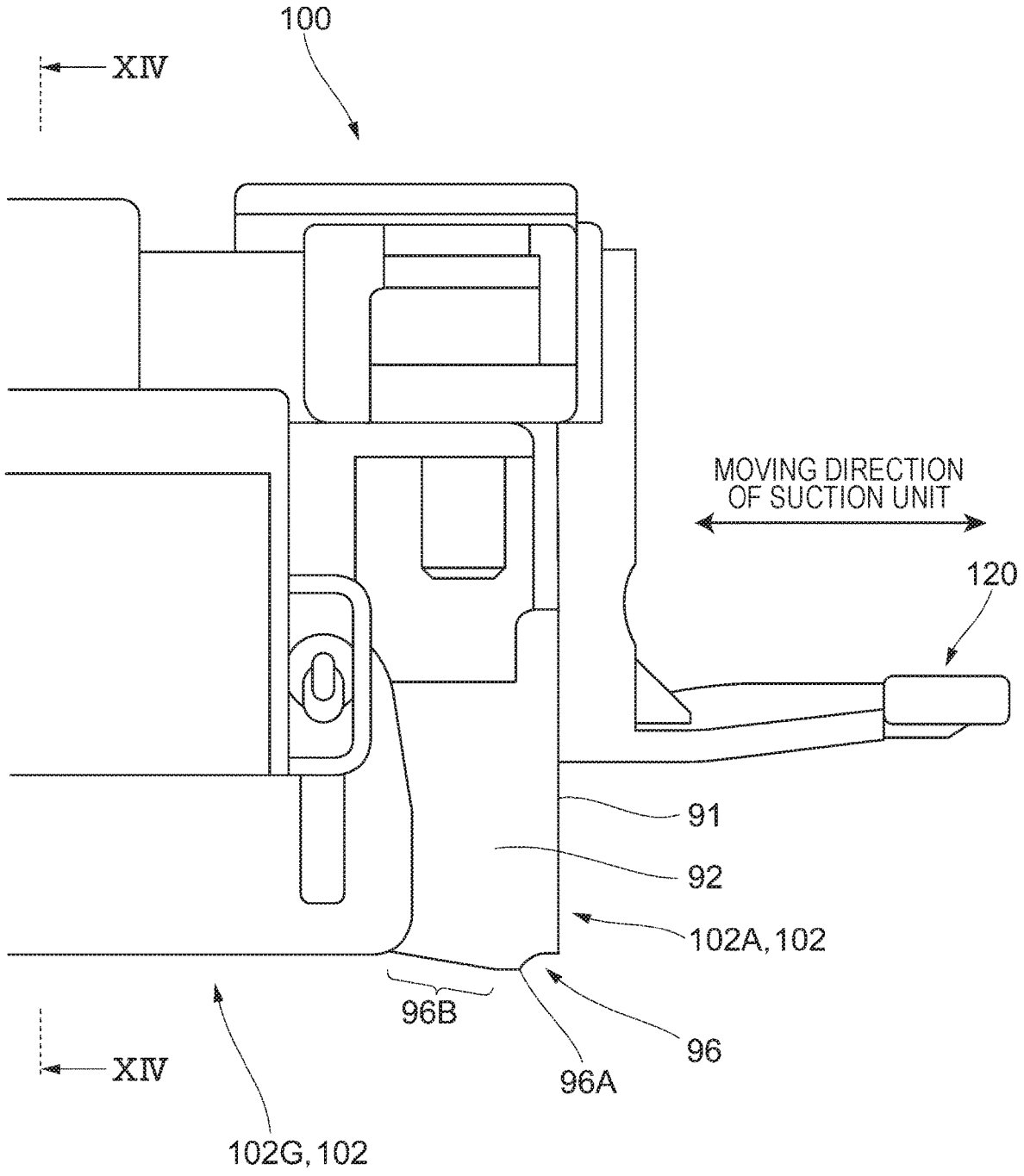
FIG. 12 illustrates the suction unit seen in a direction of arrow XII illustrated in FIG. 7.

FIG. 12 illustrates the suction unit 100 seen in a direction of arrow XII illustrated in FIG. 7.

The second segments 92 according to the present exemplary embodiment each have a lower edge 96 extending in the moving direction of the suction unit 100 and located at the lowest position of the second segment 92.

The lower edge 96 includes a projecting part 96A projecting vertically downward. The lower edge 96 further includes an inclined part 96B provided across the projecting part 96A from the first segment 91.

The inclined part 96B inclines upward while extending in a direction away from the projecting part 96A. The inclined part 96B is linear.

Figure 13B:
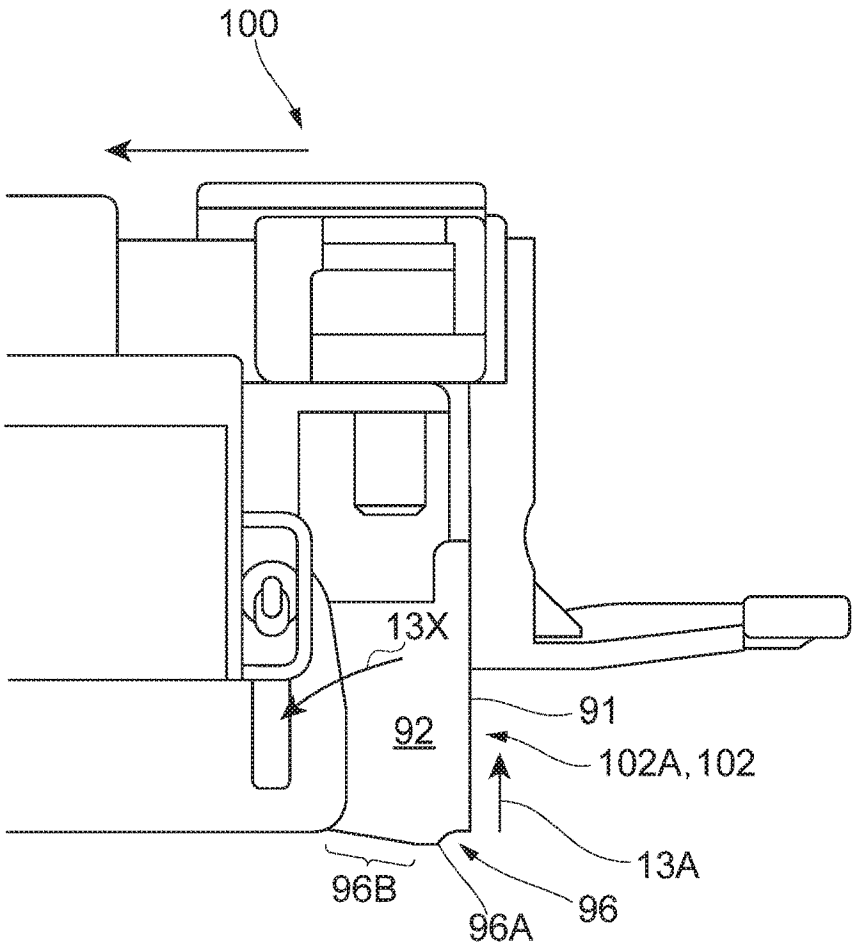
FIGS. 13A and 13B illustrate how a first leading-end movable member moves when the suction unit having moved toward an upstreammost transport roller returns toward a sheet stack.
Figure 13A:
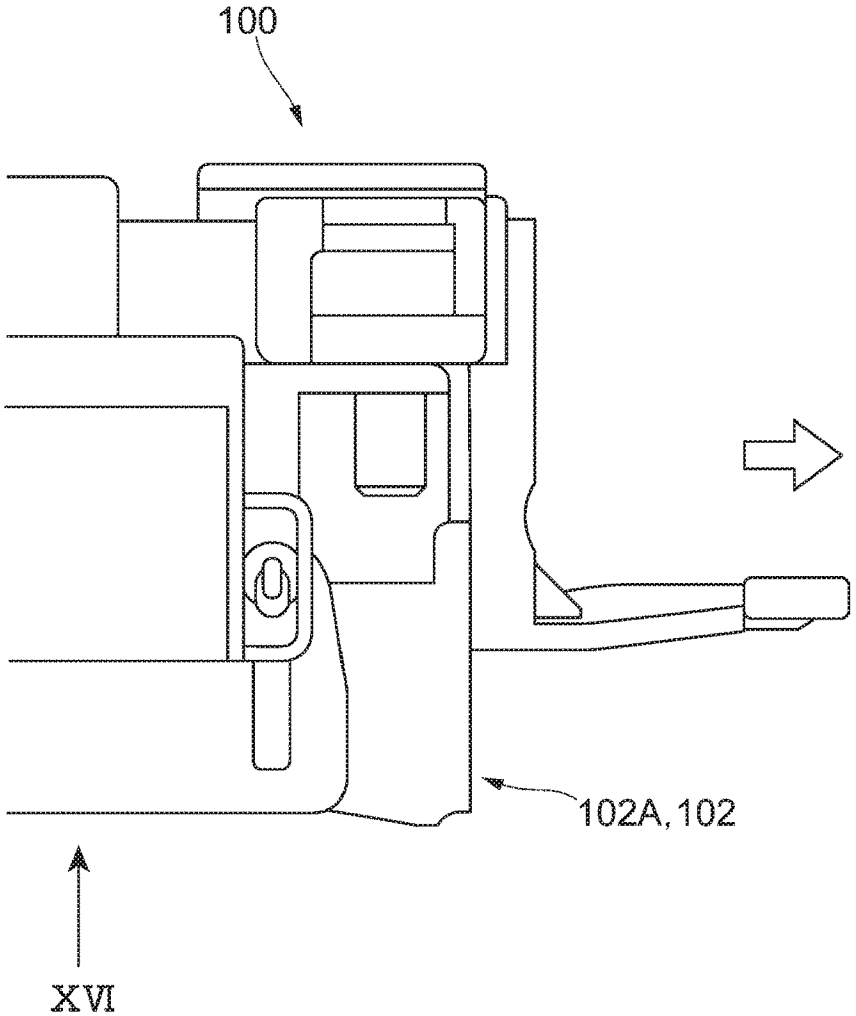

FIGS. 13A and 13B illustrate how the first leading-end movable member 102A moves when the suction unit 100 having moved toward the upstreammost transport roller 52E returns toward the sheet stack 54.

In the present exemplary embodiment, the movement of the first leading-end movable member 102A will be described. Note that the second leading-end movable member 102B (not illustrated in FIGS. 13A and 13B) moves in the same way as the first leading-end movable member 102A.

In the present exemplary embodiment, when the suction unit 100 starts to move toward the sheet stack 54 (when the suction unit 100 starts to move in a direction away from the upstreammost transport roller 52E), a drag is applied to the lower edge 96 from the sheet stack 54. Therefore, as represented by arrow 13X in FIG. 13B, the first leading-end movable member 102A tilts toward the sheet stack 54 (not illustrated in FIGS. 13A and 13B).

In such a situation, according to the present exemplary embodiment, the first segment 91 moves vertically upward as represented by arrow 13A.

Specifically, in the present exemplary embodiment, when the suction unit 100 moves toward the sheet stack 54, the first segment 91 starts to move toward the inside of the perimeter 104 of the sheet stack 54. In this process, the first segment 91 moves upward.

The first segment 91 according to the present exemplary embodiment corresponds to the outside advancing part that advances to the outside of the perimeter 104 of the sheet stack 54. In the present exemplary embodiment, the outside advancing part moves upward when the first segment 91 returns to the inside of the perimeter 104 of the sheet stack 54.

More specifically, in the present exemplary embodiment, when the first segment 91 as the outside advancing part starts to return to the inside of the perimeter 104 of the sheet stack 54, the first leading-end movable member 102A rotates on the tip of the projecting part 96A at the lower end of the second segment 92.

That is, in the present exemplary embodiment, the first leading-end movable member 102A rotates on the tip of the projecting part 96A, which is positioned nearer to the sheet stack 54 than the first segment 91.

Accordingly, the first leading-end movable member 102A tilts toward the sheet stack 54. In other words, the first leading-end movable member 102A tilts toward a side across the projecting part 96A from the first segment 91.

Consequently, in the present exemplary embodiment, the first segment 91 moves upward.

In addition, according to the present exemplary embodiment, when the first leading-end movable member 102A and the second leading-end movable member 102B tilt toward the sheet stack 54, the inclined part 96B illustrated in FIG. 13B comes into line contact with the topmost sheet P included in the sheet stack 54 (not illustrated).

In other words, according to the present exemplary embodiment, when the first leading-end movable member 102A and the second leading-end movable member 102B tilt toward the sheet stack 54, a part of the lower edge 96 that is on a side across the rotation center from the first segment 91 comes into line contact with the topmost sheet P included in the sheet stack 54.

Figure 14:
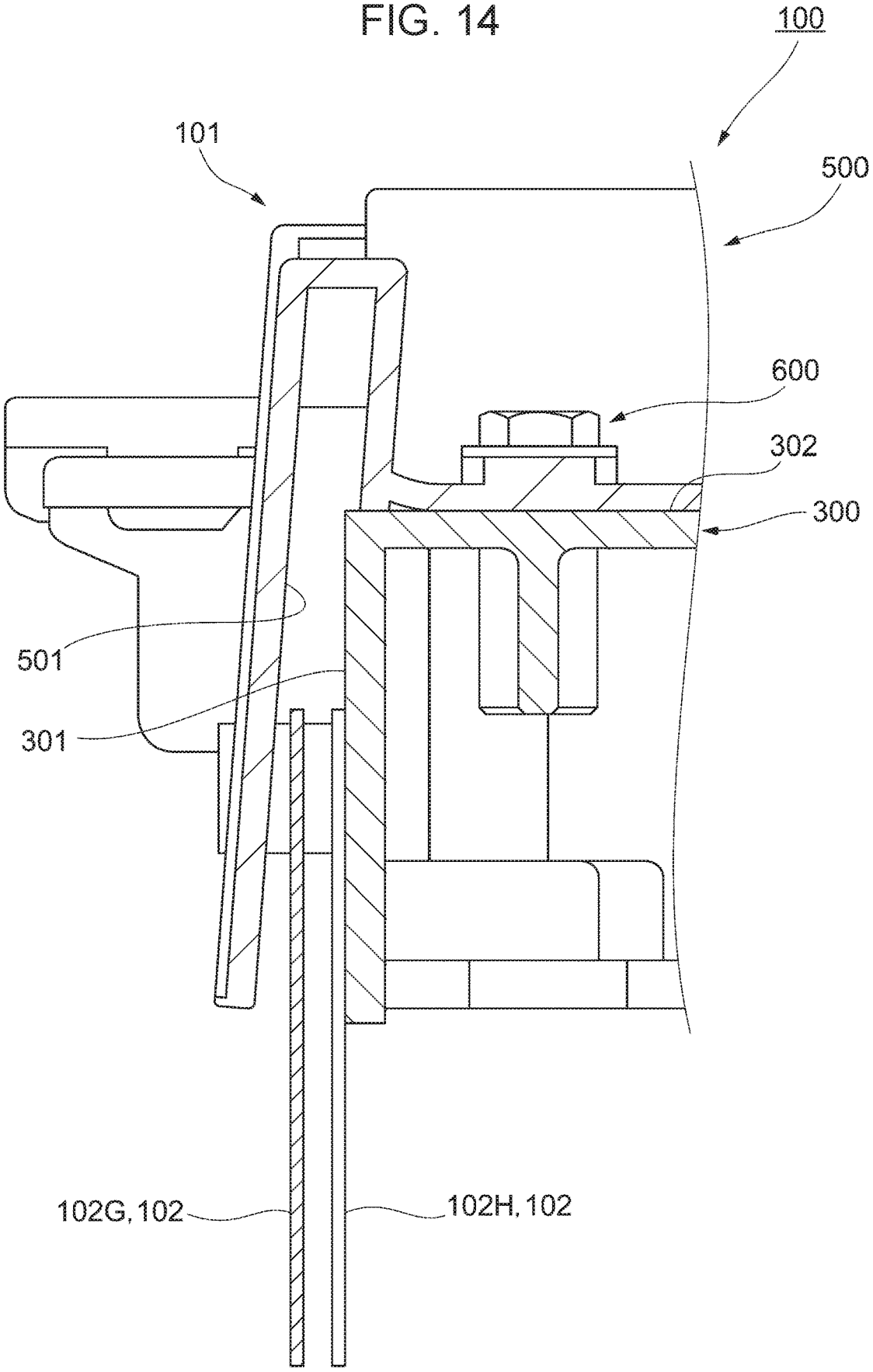
FIG. 14 is a sectional view of the suction unit taken along line XIV-XIV illustrated in FIG. 12.

FIG. 14 is a sectional view of the suction unit 100 taken along line XIV-XIV illustrated in FIG. 12. FIG. 14 illustrates a state of a part of the suction unit 100 where the first left movable member 102G and the second left movable member 102H are provided.

In the present exemplary embodiment, the unit body 101 of the suction unit 100 includes a supporting member 300 having an outer surface 301 and that supports relevant members. The unit body 101 further includes an attaching member 500 attached to an upper surface 302 of the supporting member 300.

In the present exemplary embodiment, the attaching member 500 is attached to the supporting member 300, which is an exemplary receiving member, with a fastening member 600 such as a bolt and a nut or a screw.

In the present exemplary embodiment, the attaching member 500 has a counter surface 501 that faces the first left movable member 102G and the second left movable member 102H.

Specifically, the section taken along line XIV-XIV illustrated in FIG. 12 contains the first left movable member 102G and the second left movable member 102H, which are other movable members 102 different from the first leading-end movable member 102A and the second leading-end movable member 102B.

The counter surface 501 faces the first left movable member 102G and the second left movable member 102H.

The counter surface 501 extends in an up-and-down direction. The counter surface 501 is inclined in a direction away from the first left movable member 102G and the second left movable member 102H while extending from the upper side toward the lower side.

While the present exemplary embodiment concerns a case where the counter surface 501 is inclined over the entirety thereof, the counter surface 501 does not necessarily need to be inclined over the entirety thereof. The counter surface 501 may be inclined only in part thereof.

In the present exemplary embodiment, since the counter surface 501 is inclined as described above, the contact pressure generated between the counter surface 501 and the pair of the first left movable member 102G and the second left movable member 102H is lower than in a case where the counter surface 501 is not inclined.

In the present exemplary embodiment, the attaching member 500 is attached to the supporting member 300 in such a manner as to be elastically deformed.

In the present exemplary embodiment, since the attaching member 500 is attached to the supporting member 300 in such a manner as to be elastically deformed, the counter surface 501 is inclined with respect to the vertical direction. Specifically, as described above, the counter surface 501 is inclined in the direction away from the first left movable member 102G and the second left movable member 102H while extending from the upper side toward the lower side.

Figure 15:
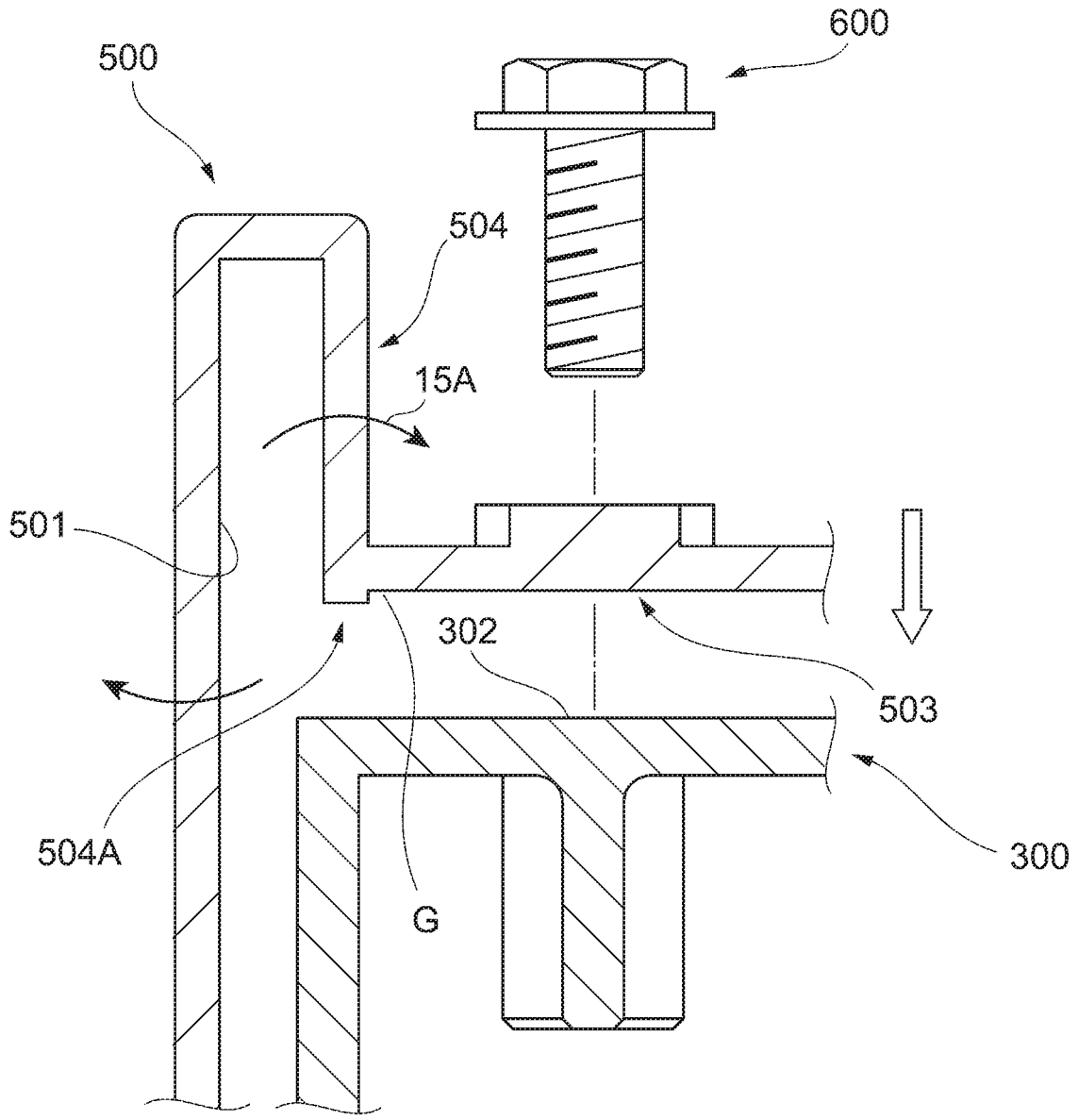
FIG. 15 illustrates an attaching member and a supporting member, with the attaching member yet to be attached to the supporting member.

FIG. 15 illustrates the attaching member 500 and the supporting member 300, with the attaching member 500 yet to be attached to the supporting member 300.

The attaching member 500 according to the present exemplary embodiment includes a meeting part 503 extending along the upper surface 302 of the supporting member 300 and meeting the upper surface 302, and an orthogonal part 504 orthogonal to the meeting part 503 and extending upward from the meeting part 503.

In the present exemplary embodiment, when the attaching member 500 is attached to the supporting member 300 with the fastening member 600, a lower end 504A of the orthogonal part 504 is pressed against the upper surface 302.

In this process according to the present exemplary embodiment, the meeting part 503 is positioned higher than the lower end 504A. Therefore, a gap G is produced between the meeting part 503 and the upper surface 302 of the supporting member 302.

Subsequently, in the present exemplary embodiment, the attaching member 500 is fastened to the supporting member 300 with the fastening member 600.

In this process, with the lower end 504A being in contact with the upper surface 302, the meeting part 503 is gradually brought closer to the upper surface 302 of the supporting member 300. Consequently, in the present exemplary embodiment, the attaching member 500 rotates on the lower end 504A in a direction of arrow 15A.

With the above rotation of the attaching member 500, the counter surface 501 is inclined with respect to the vertical direction. That is, as described above, the counter surface 501 is inclined in the direction away from the first left movable member 102G and the second left movable member 102H (not illustrated in FIG. 15) while extending from the upper side toward the lower side.

While the present exemplary embodiment concerns a case where the counter surface 501 that faces the first left movable member 102G and the second left movable member 102H is inclined, the counter surface 501 is not limited thereto.

A counter surface that faces other movable members 102 instead of the first left movable member 102G and the second left movable member 102H may be made to incline.

While the present exemplary embodiment concerns a case where the counter surface 501 is made to incline by utilizing the elastic deformation of the attaching member 500, the counter surface 501 may be made to incline by shaping the attaching member 500 such that the counter surface 501 is originally inclined.

Figure 16:
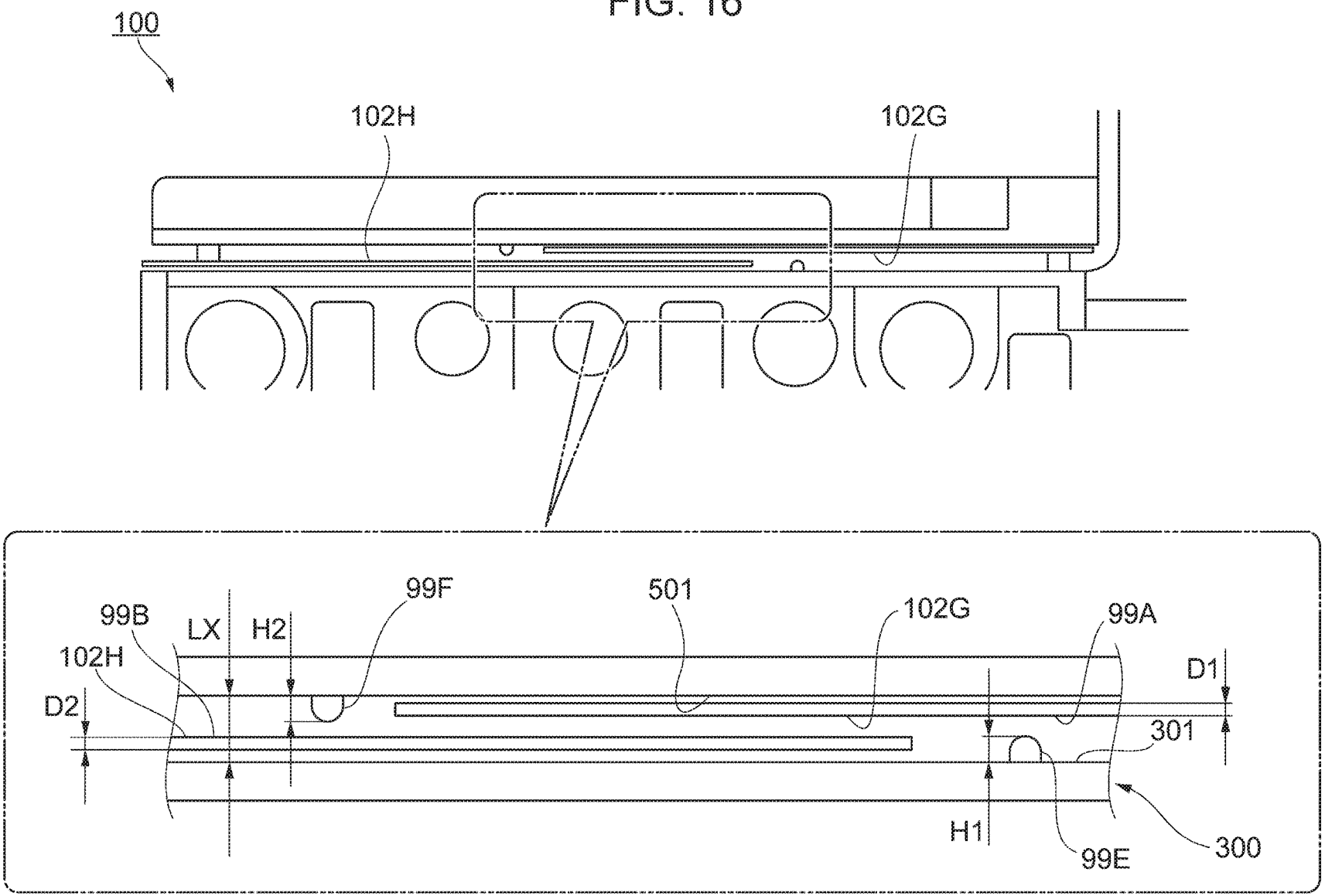
FIG. 16 illustrates the suction unit seen in a direction of arrow XVI illustrated in FIG. 13A.

FIG. 16 illustrates the suction unit 100 seen in a direction of arrow XVI illustrated in FIG. 13A. FIG. 16 illustrates a part where the first left movable member 102G and the second left movable member 102H are provided.

In the present exemplary embodiment, the first left movable member 102G as an exemplary first movable member and the second left movable member 102H as an exemplary second movable member each have a plate shape.

In the present exemplary embodiment, the first left movable member 102G and the second left movable member 102H each extend in one direction (the horizontal direction in FIG. 16) and partially overlap each other.

In the present exemplary embodiment, the second left movable member 102H faces a first surface 99A of the first left movable member 102G. In the present exemplary embodiment, the first left movable member 102G faces a first surface 99B of the second left movable member 102H.

In the present exemplary embodiment, a projecting part 99E is provided at a position facing the first surface 99A of the first left movable member 102G. The projecting part 99E projects from a side away from the first surface 99A toward the first surface 99A.

More specifically, the first surface 99A of the first left movable member 102G faces the outer surface 301 of the supporting member 300, and the outer surface 301 has the projecting part 99E projecting toward the first surface 99A.

In the present exemplary embodiment, the projecting part 99E projecting toward the first surface 99A has a projection height H1 greater than a thickness D2 of the second left movable member 102H, which is the movable member different from the first left movable member 102G having the first surface 99A.

In the present exemplary embodiment, the sum of the projection height H1 of the projecting part 99E projecting toward the first surface 99A and a thickness D1 of the first left movable member 102G having the first surface 99A is smaller than a distance LX between the counter surface 501 of the attaching member 500 and the outer surface 301 of the supporting member 300.

In the present exemplary embodiment, a projecting part 99F is provided at a position facing a first surface 99B of the second left movable member 102H. The projecting part 99F projects from a side away from the first surface 99B toward the first surface 99B.

More specifically, the first surface 99B of the second left movable member 102H faces the counter surface 501 of the attaching member 500, and the counter surface 501 has the projecting part 99F projecting toward the first surface 99B.

In the present exemplary embodiment, as with the above case, the projecting part 99F projecting toward the first surface 99B has a projection height H2 greater than the thickness D1 of the first left movable member 102G, which is the movable member different from the second left movable member 102H having the first surface 99B.

In the present exemplary embodiment, the sum of the projection height H2 of the projecting part 99F projecting toward the first surface 99B and the thickness D2 of the second left movable member 102H having the first surface 99B is smaller than the distance LX between the counter surface 501 of the attaching member 500 and the outer surface 301 of the supporting member 300.

If the projecting part 99E is provided at a position facing the first surface 99A of the first left movable member 102G as in the present exemplary embodiment, the movement of the first left movable member 102G in the thickness direction thereof and toward the second left movable member 102H is restricted.

In such a configuration, the contact pressure generated between the first left movable member 102G and the second left movable member 102H is reduced.

Likewise, if the projecting part 99F is provided at a position facing the first surface 99B of the second left movable member 102H, the movement of the second left movable member 102H in the thickness direction thereof and toward the first left movable member 102G is restricted.

In such a configuration, the contact pressure generated between the first left movable member 102G and the second left movable member 102H is reduced.

The present exemplary embodiment concerns a case where the projecting part is provided at each of the position facing the first surface 99A of the first left movable member 102G and the position facing the first surface 99B of the second left movable member 102H.

Alternatively, the projecting part may be provided only one of the position facing the first surface 99A of the first left movable member 102G and the position facing the first surface 99B of the second left movable member 102H.

The above description concerns a case where the projecting part is provided at each of the position facing the first surface 99A of the first left movable member 102G and the position facing the first surface 99B of the second left movable member 102H, that is, a case where the projecting part is provided on a member different from the movable members 102.

Alternatively, for example, the projecting part may be provided on one of or both the first surface 99A of the first left movable member 102G and the first surface 99B of the second left movable member 102H.

In such a case, the projection height of the projecting part provided on the first surface may be made greater than the thickness of the movable member 102 different from the movable member 102 having the first surface.

That is, if the projecting part is provided on the first surface 99A of the first left movable member 102G, the projection height of the projecting part may be made greater than the thickness D2 of the second left movable member 102H, which is the movable member 102 different from the first left movable member 102G having the first surface 99A.

If the projecting part is provided on the first surface 99B of the second left movable member 102H, the projection height of the projecting part may be made greater than the thickness D1 of the first left movable member 102G, which is the movable member 102 different from the second left movable member 102H having the first surface 99B.

The number of projecting parts is not limited. One or a plurality of projecting parts may be provided at each of the positions facing the first surfaces 99A and 99B or on each of the first surfaces 99A and 99B themselves.

Furthermore, the projecting part may have, for example, a rib shape extending in the direction in which the movable member 102 moves.

The above description concerns a case where the projecting part is provided at each of the positions that face the first left movable member 102G and the second left movable member 102H or on each of the first left movable member 102G and the second left movable member 102H themselves. However, the position of the projecting part is not limited thereto.

The projecting part may be provided at a position facing another movable member 102 instead of the first left movable member 102G and the second left movable member 102H, or on the other movable member 102 itself.

Figure 17:
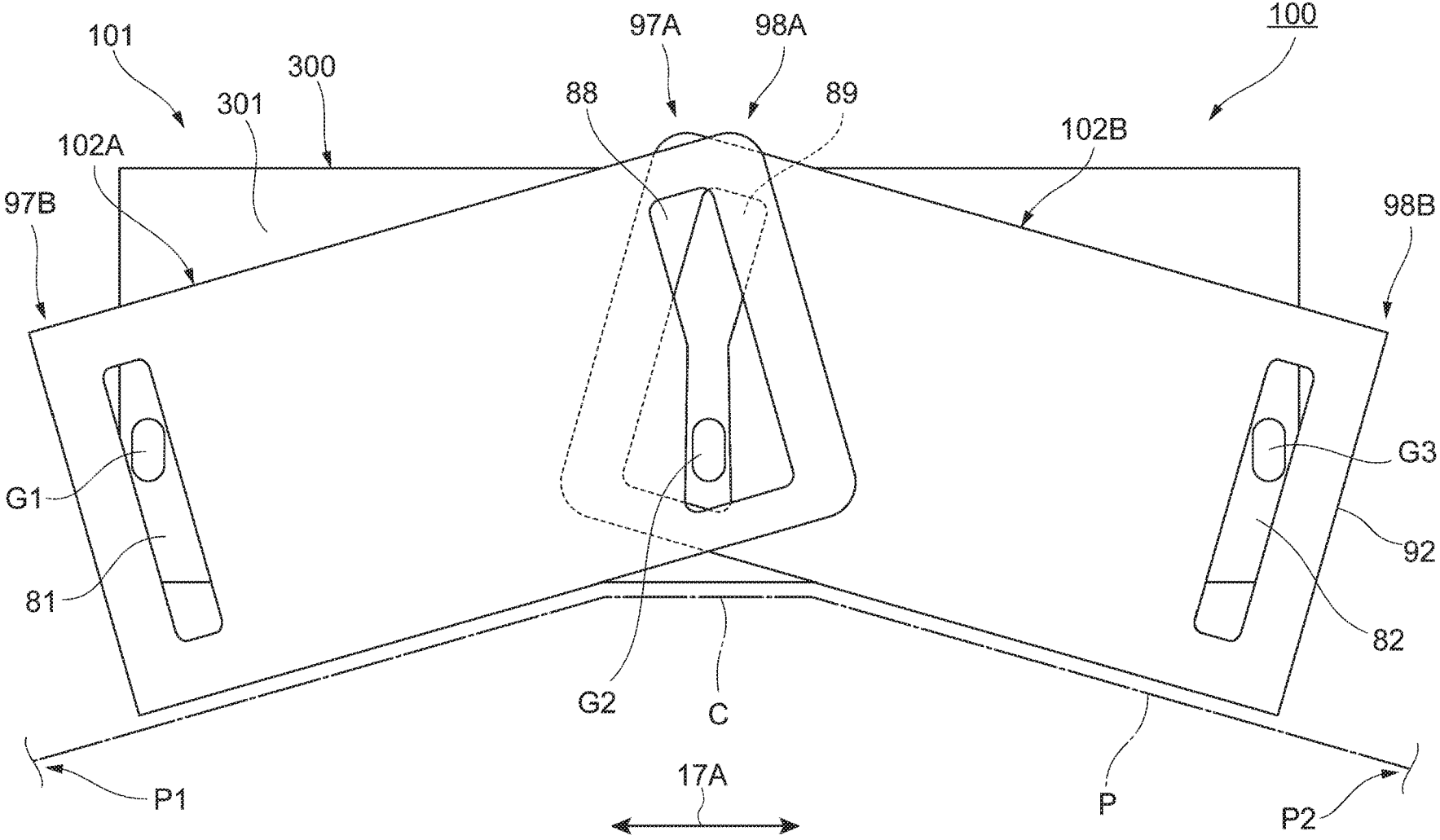
FIG. 17 illustrates the suction unit seen in a direction of arrow XVII illustrated in FIG. 7.

FIG. 17 illustrates the suction unit 100 seen in a direction of arrow XVII illustrated in FIG. 7.

More specifically, FIG. 17 illustrates the first leading-end movable member 102A and the second leading-end movable member 102B that have been pushed by the sheets P from below and thus moved upward.

FIG. 17 also illustrates a state of the suction unit 100 that is suctioning a sheet P having a large width in a direction of arrow 17A illustrated therein. In FIG. 17, the air guiding member 120 is not illustrated.

When a sheet P with a large width is suctioned by the suction unit 100, two widthwise ends of the sheet P hang down, and the first leading-end movable member 102A and the leading-end movable member 102B each tilt with respect to the horizontal direction as illustrated in FIG. 17.

The first leading-end movable member 102A includes a center-side end 97A positioned nearer to a widthwise central part C of the sheet P positioned therebelow, and an opposite-side end 97B positioned opposite the center-side end 97A and nearer to a widthwise end P1 of the sheet P.

The second leading-end movable member 102B includes a center-side end 98A positioned nearer to the widthwise central part C of the sheet P positioned therebelow, and an opposite-side end 98B positioned opposite the center-side end 98A and nearer to a widthwise end P2 of the sheet P.

In the present exemplary embodiment, when a sheet P having a large width is suctioned by the suction unit 100, the first leading-end movable member 102A tilts such that the opposite-side end 97B is positioned lower than the center-side end 97A.

Likewise, when a sheet P having a large width is suctioned by the suction unit 100, the second leading-end movable member 102B tilts such that the opposite-side end 98B is positioned lower than the center-side end 98A.

Furthermore, in the present exemplary embodiment, the outer surface 301 (the surface facing the first leading-end movable member 102A and the second leading-end movable member 102B) of the supporting member 300 included in the unit body 101 has a first to third guiding parts G1 to G3 that guide the first leading-end movable member 102A and the second leading-end movable member 102B.

When the first leading-end movable member 102A and the second leading-end movable member 102B move up and down, the first to third guiding parts G1 to G3 guide the first leading-end movable member 102A and the second leading-end movable member 102B.

In the present exemplary embodiment, the first leading-end movable member 102A has a groove 88 provided near the center-side end 97A. The groove 88 extends in the up-and-down direction and receives the second guiding part G2.

The second leading-end movable member 102B has a groove 89 provided near the center-side end 98A. The groove 89 extends in the up-and-down direction and receives the second guiding part G2.

Furthermore, the first leading-end movable member 102A has a groove 81 provided near the opposite-side end 97B and that receives the first guiding part G1, and the second leading-end movable member 102B has a groove 82 provided near the opposite-side end 98B and that receives the third guiding part G3.

Figure 18:
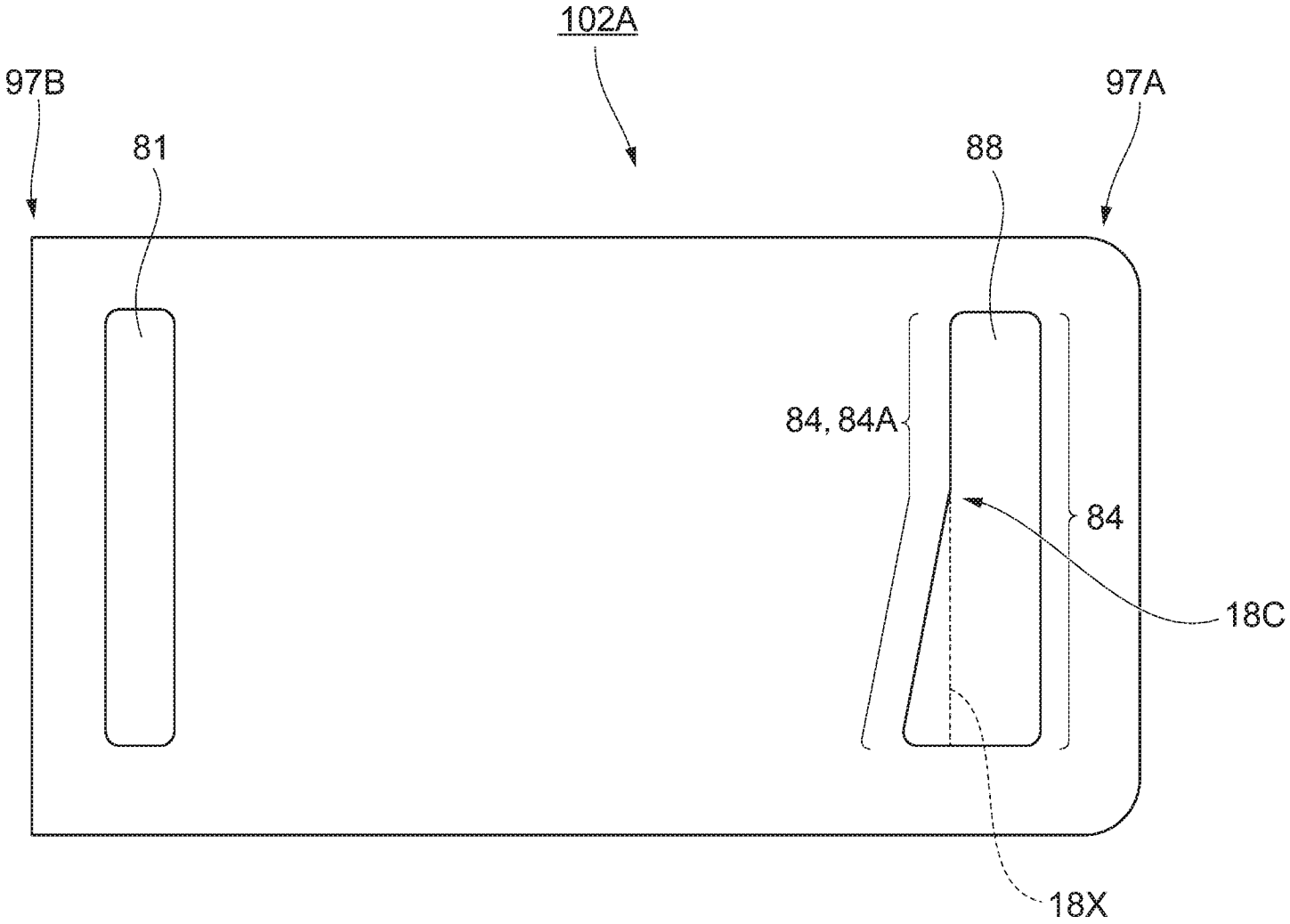
FIG. 18 is a front view of the first leading-end movable member.

FIG. 18 is a front view of the first leading-end movable member 102A.

As described above, the first leading-end movable member 102A has, in a region near the center-side end 97A, the groove 88 extending in the up-and-down direction and that receives the second guiding part G2.

Two sides of the groove 88 are defined by edges 84A, respectively. The edges 84A each extend in the up-and-down direction and face the groove 88.

In the present exemplary embodiment, one of the edges 84 on the two respective sides of the groove 88 that is positioned nearer to the opposite-side end 97B is denoted as "edge 84A". The edge 84A is inclined toward the opposite-side end 97B while extending downward.

More specifically, a part of the edge 84A that is on the lower side with respect to a central part 18C in the up-and-down direction is inclined toward the opposite-side end 97B while extending downward.

In the present exemplary embodiment, as illustrated in FIG. 17, the first leading-end movable member 102A tilts such that the center-side end 97A is positioned higher than the opposite-side end 97B.

In such a configuration, if the edge 84A (see FIG. 18) is linear as illustrated by broken line 18X, the first leading-end movable member 102A and the second guiding part G2 interfere with each other, making it difficult for the first leading-end movable member 102A to tilt.

Such a configuration makes it difficult for the first leading-end movable member 102A to follow the bend in the sheet P. Consequently, a gap tends to be produced between the sheet P and the first leading-end movable member 102A. If such a gap is produced, the attraction of the sheet P with the suction unit 100 tends to be disabled.

In contrast, if the edge 84A is inclined as in the present exemplary embodiment, the first leading-end movable member 102A easily tilt and follow the bend in the sheet P.

While the above description concerns the first leading-end movable member 102A, the second leading-end movable member 102B also has the same configuration. Therefore, the second leading-end movable member 102B easily follow the bend in the sheet P.

The first leading-end movable member 102A and the second leading-end movable member 102B are also made to easily tilt by increasing the widths of the grooves 88 and 89 over the entirety thereof.

However, such a configuration widens the gap produced between the second guiding part G2 and the edge 84 of each of the grooves 88 and 89 when the first leading-end movable member 102A and the second leading-end movable member 102B are lowered.

In such a situation, the positions of the first leading-end movable member 102A and the second leading-end movable member 102B that have been lowered tend to vary.

In contrast, the configuration in which only part of the edge 84A is inclined as described above reduces the gap produced between the second guiding part G2 and the edge 84 of each of the grooves 88 and 89 when the first leading-end movable member 102A and the second leading-end movable member 102B are lowered.

FIGS. 17 and 18 concern a case where the edge 84 of each of the grooves 88 and 89 provided in the first leading-end movable member 102A and the second leading-end movable member 102B includes an inclined part. Alternatively, the movable members 102 other than the first leading-end movable member 102A and the second leading-end movable member 102B may also have grooves each defined by an edge including an inclined part.

Figure 19:
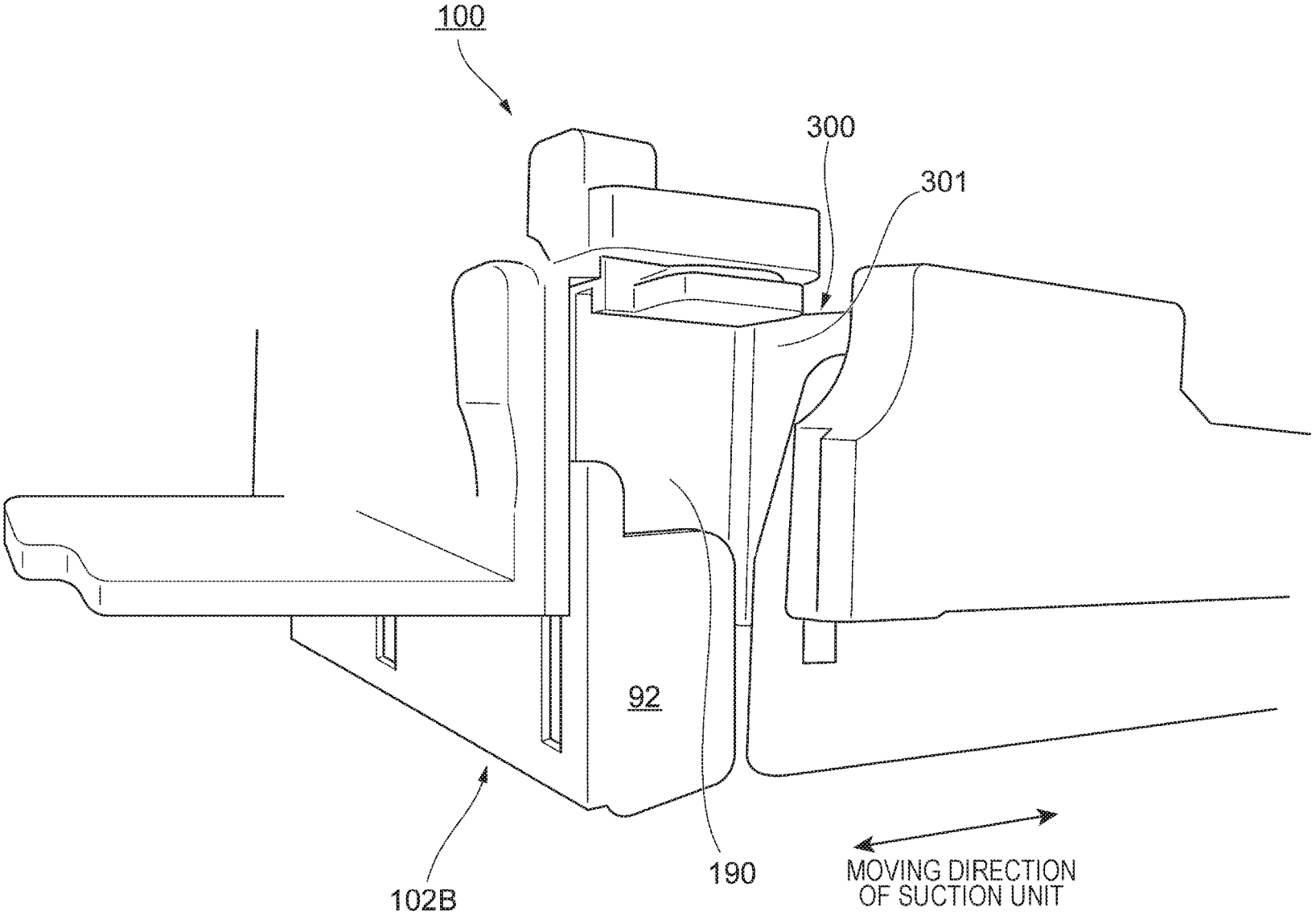
FIG. 19 illustrates the suction unit seen in a direction of arrow XIX illustrated in FIG. 7.

FIG. 19 illustrates the suction unit 100 seen in a direction of arrow XIX illustrated in FIG. 7.

The outer surface 301 of the supporting member 300, i.e. the outer surface 301 extending in the moving direction of the suction unit 100, has a recess 190.

More specifically, the outer surface 301 of the supporting member 300 has the recess 190 in a region facing the second segment 92 of the second leading-end movable member 102B.

In the present exemplary embodiment, as illustrated in FIG. 17, when a sheet P having a large width is suctioned with the suction unit 100, the second leading-end movable member 102B tilts such that the center-side end 98A is positioned higher than the opposite-side end 98B. Accordingly, as illustrated in FIG. 17, the second segment 92 tilts.

In such a situation, if the recess 190 is provided as described above, the second segment 92 and the supporting member 300 are less likely to interfere with each other, allowing the second leading-end movable member 102B to tilt easily. Therefore, the second leading-end movable member 102B easily follow the sheet P.

FIG. 19 illustrates a region of the supporting member 300 that faces the second segment 92 of the second leading-end movable member 102B. In the present exemplary embodiment, a region of the supporting member 300 that faces the second segment 92 of the first leading-end movable member 102A also has a recess.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording-material-transporting device comprising:

a suction unit that suctions a recording material included in a recording-material stack from above, the suction unit including a movable member that moves upward when pushed from below by the recording material moving upward with the suction, the suction unit being movable in an intersecting direction intersecting a vertical direction and moving the suctioned recording material in the intersecting direction, at least a part of the movable member serving as an outside advancing part that advances to an outside of a perimeter of the recording-material stack with the movement of the suction unit in the intersecting direction; and a restricting part that restricts a downward movement of the outside advancing part when the outside advancing part is free of support by the recording material from below, wherein the outside advancing part moves upward when returning to an inside of the perimeter, wherein when the outside advancing part returns to the inside of the perimeter, the movable member tilts toward an opposite side that is away from the outside advancing part by rotating on a rotation center defined at a lower end of the movable member and at a position nearer to the recording-material stack than the outside advancing part, and wherein the tilting of the movable member toward the opposite side with the rotation of the movable member on the rotation center causes the outside advancing part to move upward.

2. The recording-material-transporting device according to claim 1, further comprising:

an interlocked part that is interlocked with the outside advancing part and extends from the outside to the inside of the perimeter of the recording-material stack, wherein the downward movement of the outside advancing part is restricted when the interlocked part is supported by the recording-material stack from below.

3. The recording-material-transporting device according to claim 2, wherein the interlocked part separates a depressurized space provided at the suction with the suction unit from an atmospheric space being at atmospheric pressure.

4. The recording-material-transporting device according to claim 1, wherein the movable member separates a depressurized space provided at the suction with the suction unit from an atmospheric space being at atmospheric pressure.

5. The recording-material-transporting device according to claim 1, wherein when the movable member is seen from vertically above, the movable member has an L shape including a first segment and a second segment that intersect each other, wherein the first segment serves as the outside advancing part, wherein the second segment is supported by the recording-material stack from below, and wherein the second segment supported by the recording-material stack from below restricts a downward movement of the first segment advancing to the outside of the perimeter.

6. The recording-material-transporting device according to claim 1, wherein the movable member has a plate shape and is one of a plurality of movable members, wherein a first one of the movable members and a second one of the movable members each extend in one direction and partially overlap each other such that the second movable member faces a first surface of the first movable member while the first movable member faces a first surface of the second movable member, and wherein a projecting part is provided at at least one of a position facing the first surface of the first movable member and a position facing the first surface of the second movable member, the projecting part projecting from a side away from the first surface toward the first surface.

7. The recording-material-transporting device according to claim 6, wherein the projecting part projecting toward the first surface has a projection height greater than a thickness of the movable member different from the movable member having the first surface toward which the projecting part projects.

8. The recording-material-transporting device according to claim 1, wherein the movable member has a plate shape and is one of a plurality of movable members, wherein a first one of the movable members and a second one of the movable members each extend in one direction and partially overlap each other such that the second movable member faces a first surface of the first movable member while the first movable member faces a first surface of the second movable member, and wherein a projecting part is provided on at least one of the first surface of the first movable member and the first surface of the second movable member.

9. The recording-material-transporting device according to claim 8, wherein the projecting part provided on the first surface has a projection height greater than a thickness of the movable member different from the movable member having the first surface toward which the projecting part projects.

10. The recording-material-transporting device according to claim 1, further comprising:

a counter surface that extends in an up-and-down direction and faces the movable member or another movable member, wherein at least a part of the counter surface is inclined in a direction away from the movable member while extending from an upper side toward a lower side.

11. The recording-material-transporting device according to claim 10, wherein a member having the counter surface is attached to a receiving member in such a manner as to be elastically deformed, and wherein attaching the member having the counter surface to the receiving member in such a manner as to be elastically deformed makes the part of the counter surface inclined with respect to the vertical direction and in the direction away from the movable member while extending from the upper side toward the lower side.

12. The recording-material-transporting device according to claim 1, wherein when the movable member tilts toward the opposite side, a part of the lower end that is positioned across the rotation center from the outside advancing part comes into line contact with a topmost one of the recording materials included in the recording-material stack.

13. The recording-material-transporting device according to claim 1, further comprising:

a guiding part that guides the movable member or another movable member when the movable member moves upward by being pushed by the recording material positioned below the movable member, wherein the movable member includes a center-side end positioned nearer to a widthwise central part of the recording material positioned below the movable member; and an opposite-side end positioned opposite the center-side end and nearer to one widthwise end of the recording materials, wherein the movable member has a groove near the center-side end, the groove extending in an up-and-down direction and receiving the guiding part, wherein two side of the groove are defined by edges, respectively, the edges each extending in the up-and-down direction and facing the groove, and wherein one of the edges that is positioned nearer to the opposite-side end is inclined toward the opposite-side end while extending downward.

14. An image forming apparatus comprising:

an image forming device that forms an image on a recording material; and the recording-material-transporting device according to claim 1.

15. A recording-material-transporting device comprising:

a suction unit that suctions a recording material included in a recording-material stack from above, the suction unit moving the suctioned recording material in an intersecting direction intersecting a vertical direction, the suction unit including a plate-shaped movable member that separates a depressurized space provided by the suction from an atmospheric space being at atmospheric pressure, the movable member being movable in an up-and-down direction, wherein the plate-shaped movable member is one of a plurality of movable members, wherein a first one of the movable members and a second one of the movable members each extend in one direction and partially overlap each other such that the second movable member faces a first surface of the first movable member while the first movable member faces a first surface of the second movable member, wherein a projecting part is provided at at least one of a position facing the first surface of the first movable member and a position facing the first surface of the second movable member, the projecting part projecting from a side away from the first surface toward the first surface, or the projecting part is provided on at least one of the first surface of the first movable member and the first surface of the second movable member.

16. A recording-material-transporting device comprising:

a suction unit that suctions a recording material included in a recording-material stack from above, the suction unit moving the suctioned recording material in one direction, the suction unit including a movable member that separates a depressurized space provided by the suction from an atmospheric space being at atmospheric pressure, the movable member being positioned on a downstream side with respect to the depressurized space in the one direction and being movable in an up-and-down direction; and a counter surface that extends in the up-and-down direction and faces the movable member or another movable member, wherein a part of the movable member extends in a direction opposite to the one direction, wherein at least a part of the counter surface is inclined in a direction away from the movable member while extending from an upper side toward a lower side, wherein a member having the counter surface is attached to a receiving member in such a manner as to be elastically deformed.

* * * * *